US005219722A

United States Patent [19]

Tanaka et al.

[11] Patent Number: 5,219,722

[45] Date of Patent: Jun. 15, 1993

[54] SILVER HALIDE COLOR PHOTOGRAPHIC LIGHT-SENSITIVE MATERIAL

[75] Inventors: Yuji Tanaka; Mitsuhiro Okumura; Masataka Nakano, all of Hino, Japan

[73] Assignee: Konica Corporation, Tokyo, Japan

[21] Appl. No.: 760,403

[22] Filed: Sep. 16, 1991

[30] Foreign Application Priority Data

Sep. 21, 1990 [JP] Japan ..... 2-253672
Sep. 22, 1990 [JP] Japan ..... 2-253318

[51] Int. Cl.[5] ..... G03C 1/09; G03C 1/16

[52] U.S. Cl. ..... 430/574; 430/575; 430/583; 430/603; 430/604; 430/605; 430/611; 430/614

[58] Field of Search ..... 430/567, 574, 583, 611, 430/614, 603, 605, 575, 604

[56] References Cited

U.S. PATENT DOCUMENTS

| | | | |
|---|---|---|---|
| 3,189,458 | 6/1965 | Herz | 430/603 |
| 3,976,492 | 8/1976 | Hinata et al. | 430/574 |
| 4,469,785 | 9/1984 | Tanaka et al. | 430/574 |
| 4,863,846 | 9/1989 | Tanaka et al. | 430/603 |
| 4,914,016 | 4/1990 | Miyashi et al. | 430/603 |
| 5,004,680 | 4/1991 | Yagi et al. | 430/603 |
| 5,081,006 | 1/1992 | Tanaka et al. | 430/574 |

FOREIGN PATENT DOCUMENTS

| | | |
|---|---|---|
| 0264288 | 4/1988 | European Pat. Off. . |
| 0327272 | 8/1989 | European Pat. Off. . |
| 2533374 | 2/1976 | Fed. Rep. of Germany . |
| 3902711 | 8/1989 | Fed. Rep. of Germany . |

*Primary Examiner*—Charles L. Bowers, Jr.
*Assistant Examiner*—Janet C. Baxter
*Attorney, Agent, or Firm*—Frishauf, Holtz, Goodman & Woodward

[57] ABSTRACT

A silver halide color photographic light-sensitive material is disclosed. The light-sensitive material comprises a support having thereon a silver halide emulsion layer containing silver halide grains each containing an iridium compound and a compound containing iron, cobalt, nickel, ruthenium, rhodium, palladium, osmium or platinum; elemental sulfur; and two kinds of specified monomethine cyanine sensitizing dyes. The light sensitive material is improved in the reciprocity law failure property and the sensitivity fluctuation due to variation of atmosphere humidity.

14 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, more specifically to a silver halide color photographic light-sensitive material which is suitable for printing color printing paper and other photographic materials.

BACKGROUND OF THE INVENTION

In recent years, there have been customer's demands for prints with increasing photographic image quality. In the existing photo-finishing laboratories, it is a common practice to obtain a large number of prints using automatic printers. However, since the humidity in the printer changes, for instance, according to the change in the atmospheric humidity from early morning to midday, the desired print quality is not obtained in some cases, due to color fluctuation in the finished print, when the sensitivity of the color printing paper is significantly affected by humidity change, which in turn can significantly affect productivity of the laboratory. This aspect poses a more difficult problem on "mini-labs", which have recently been common, since they are not air conditioned.

It is a well-known fact, published in Japanese Patent Publication Open to Public Inspection (hereinafter referred to as Japanese Patent O.P.I. Publication) No. 20852/1990, that reciprocity law failure is improved by the silver halide emulsion described above, which comprises silver halide grains containing at least two compounds each containing one of the transition metals belonging to the groups II and V through VIII in the periodic table of elements.

Gold sensitization increases the sensitivity and improves the reciprocity law failure of silver halide emulsion, but it causes fogging.

Japanese Patent O.P.I. Publication Nos. 24246/1989 and 86135/1989 state that fogging can be suppressed by adding elemental sulfur upon chemical sensitization; however, this method proved to pause a problem of increased fluctuation of sensitivity upon humidity change (hereinafter referred to as humidity dependency), specifically a problem of significant deterioration over the humidity range from moderate to low humidities.

SUMMARY OF THE INVENTION

It is an object of the present invention to provide a silver halide color photographic light-sensitive material which is excellent in reciprocity law failure property and whose sensitivity does not show significant fluctuation upon humidity change.

A silver halide color photographic light-sensitive materials of the invention comprises a support having thereon a silver halide emulsion layer containing silver halide grains each containing an iridium compound and a compound containing iron, cobalt, nickel, ruthenium, rhodium, palladium, osmium or platinum; elemental sulfur; a sensitizing dye represented by Formula I; and a sensitizing dye represented by Formula II;

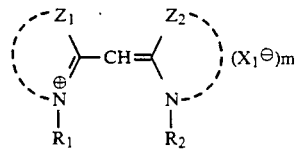

Formula I wherein $Z_1$ and $Z_2$ are each a group of atoms necessary for forming a thiazole ring, a selenazole ring, a benzothiazole ring, a benzosalanazole ring, a naphthothiazole ring or a naphthoselenazole ring provided that at least one of $Z_1$ and $Z_2$ is a naphthothiazole ring or a naphthoselenazole ring; $R_1$ and $R_2$ are each an aliphatic group provided that at least one of them is an aliphatic group having a carboxyl group or a sulfo group; $X_1\ominus$ is an acid anion and m is 0 or 1;

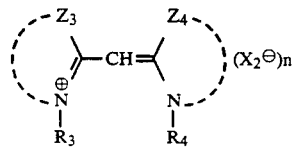

Formula II wherein $Z_3$ and $Z_4$ are each a group of atoms necessary for forming a thiazole ring, a benzothiazole ring or a benzoselenazole ring; $R_3$ and $R_4$ are each an aliphatic group provided that at least one of them is an aliphatic group having a carboxyl group or a sulfo group; $X_2\ominus$ is an acid anion and m is 0 or 1.

DETAILED DESCRIPTION OF THE INVENTION

The silver halide grains of the present invention contain an iridium compound and a compound containing a transition metal other than iridium belonging to the group VIII in the periodic table of elements.

The iridium compound is a trivalent or quadrivalent salt or complex salt. Typical examples thereof include iridium (III) chloride, iridium (III) bromide, secondary iridium chloride, potassium hexachloroiridate (III), potassium hexachloroiridate (IV), hexammineiridium (III) salt, hexammineiridium (IV) salt, trioxalatoiridium (III) salt and trioxalatoiridium (IV) salt.

The amount of iridium compound used is normally $1\times10^{-11}$ to $5\times10^{-5}$ mol, preferably $1\times10^{-9}$ to $5\times10^{-6}$ mol per mol of silver.

The compounds containing a metal other than iridium belonging to the group VIII in the periodic table of elements are compounds of iron, cobalt, nickel, ruthenium, rhodium, palladium, osmium and platinum, respectively. Typical examples thereof include potassium ferricyanide, potassium ferrocyanide, ferrous thiocyanate, ferric thiocyanate, ferrous chloride, ferric chloride, cobalt chloride, cobalt nitrate, luteo salt, nickel chloride, nickel sulfate, ruthenium chloride, ruthenium hydroxide, rhodium chloride, ammonium hexachlororhodate, palladium chloride, palladium nitrate, potassium hexachloropalladate, osmium chloride, ammonium hexachloroplatinate and potassium hexachloroplatinate. The nitrosyl, thionitrosyl and complex salts containing a thionitrosyl ligand described in Japanese Patent O.P.I. Publication No. 20852/1990 are also preferably used.

The amount of compound containing a transition metal other than iridium belonging to the group VIII in the periodic table of elements is suitably $1\times10^{-9}$ to $1\times10^{-3}$ mol, preferably $1\times10^{-8}$ to $1\times10^{-4}$ mol per mol of silver halide, in which range the effect of the invention is enhanced.

In the present invention, an iridium compound and a compound containing a transition metal other than iridium belonging to the group VIII are added to silver halide grains upon their preparation, addition of the metal salts may be performed at once, continuously or intermittently.

The iridium compound and the compound containing a metal other than iridium belonging to the group VII preferably co-exist upon formation of silver halide grains.

The silver halide emulsion of the present invention may be subjected to a combination of reduction sensitization using a reducing agent, noble metal sensitization using a noble metal compound and other sensitization methods, but gold sensitization is preferred for improving a reciprocity law failure.

Any gold compound in common use as a gold sensitizer can be used, whether the oxidation number of gold is +1 or 3. Typical examples thereof include chloroauric acid, potassium chloroaurate, auric trichloride, potassium auric thiocyanate, potassium iodoaurate, tetracyanoauric acid, ammonium aurothiocyanate and pyridyl trichloroaurate.

Although the amount of gold sensitizer added varies according to various conditions, it is preferably $5\times10^{-7}$ to $5\times10^{-3}$ mol, more preferably $2\times10^{-6}$ to $1\times10^{-4}$, and still more preferably $2.6\times10^{-6}$ to $4\times10^{-5}$ mol per mol of silver halide.

However, the use of a gold sensitizer and a chalcogen sensitizer in combination does not always offer the desired effect since the gradation becomes soft and fogging is likely to occur, though it is effective on improvement in the sensitivity and improvement in reciprocity law failure. Then, elemental sulfur as described in Japanese Patent O.P.I. Publication No. 45016/1980 and other publications was added to obtain harder gradation and suppress fogging.

In the present invention, a chalcogen sensitizer may be used in combination with a gold compound. The chalcogen sensitizer is a generic name for sulfur sensitizers, selenium sensitizers and tellurium sensitizers, but sulfur sensitizers and selenium sensitizers are preferred, with more preference given to sulfur sensitizers.

Examples of sulfur sensitizers include thiosulfates, allyl thiocarbamides, thioureas, allyl isothiocyanates, cystine, p-toluenethiosulfonate and rhodanines. The sulfur sensitizers described in U.S. Pat. Nos. 1,574,944 and 3,656,955, German Patent No. 1,422,869, Japanese Patent Examined Publication No. 24937/1981, Japanese Patent O.P.I. Publication No. 45016/1980 and other publications can also be used. The sulfur sensitizer is added in an amount sufficient to effectively increase the sensitivity of emulsion. Although this amount varies over a rather wide range according to various conditions such as pH, temperature and AgX grain size, the amount is preferably $10^{-7}$ to $10^{-1}$ mol per mol of silver halide.

The elemental sulfur for the present invention is added during preparation of silver halide emulsion. It offers an excellent effect when it is added at any time by completion of chemical sensitization, also referred to as chemical ripening in the preparation process.

In this context, completion of chemical sensitization coincides with addition of a chemical sensitization stopper in the sensitization process. This timing may be simultaneous with addition of the chemical sensitization stopper or within about 10 minutes before or after it, preferably simultaneously or within 5 minutes before or after it.

Specifically, the timing of addition of elemental sulfur before completion of chemical sensitization may be before formation of silver halide grains, during formation of silver halide grains, between completion of formation of silver halide grains and initiation of chemical sensitization, during chemical sensitization or by completion of chemical sensitization. Preferably, elemental sulfur is added at any time arbitrarily selected between completion of formation of silver halide grains and initiation of chemical sensitization, during chemical sensitization and by completion of chemical sensitization. The entire amount may be added at a time or in several stages.

The silver halide emulsion of the present invention permits prevention of tone softening and fogging aggravation while maintaining a high degree of chemical sensitization by the use of element sulfur.

The simple substance sulfur used as "element sulfur" for the present invention is known to involve some allotropes, any of which can be used.

Of the allotropes, α-sulfur, which belongs to the orthorhombic system, is stable at room temperature, which is preferably used for the present invention.

Although the "elemental sulfur" for the present invention may be added in a solid powder form, it is preferable to add it in solution. Elemental sulfur is known to be insoluble in water and soluble in carbon disulfide, sulfur chloride, benzene, diethyl ether, ethanol and other solvents. Elemental sulfur is added preferably in solution in these solvents, of which ethanol is preferred from the viewpoint of handling, photographic influence and other aspects.

The amount of elemental sulfur added varies depending on the type of silver halide emulsion used, the degree of desired effect and other factors; it is normally $1\times10^{-5}$ to 10 mg, preferably $1\times10^{-3}$ to 5 mg per mol of silver halide.

Although elemental sulfur may be added at any time point by completion of chemical sensitization, it is preferable to add it upon initiation of chemical sensitization or separately upon initiation and completion of chemical sensitization for effectively obtaining harder gradation and reduced fogging while maintaining a high sensitivity.

However, when an Ir/Fe-doped emulsion incorporated a combination of a gold sensitizer and elemental sulfur and two sensitizing dyes, the reciprocal law failure property is good but the fluctuation of sensitivity upon humidity change is very wide, which makes it undesirable to use the emulsion in a light-sensitive material for prints. This problem is solved by the use of two or more particular sensitizing dyes in combination, which stabilizes the sensitivity against humidity change.

The blue-sensitive emulsion layer according to the present invention is sensitized with a combination of at least one sensitizing dye represented by Formula I and at least one sensitizing dye represent by Formula II.

With respect to Formula I, the rings (nuclei) for $Z_1$ and $Z_2$ may have a substituent at a position in addition to the positions where a nitrogen atom is present. Examples of the substituent include halogen atoms such as chlorine, bromine and fluorine atoms, alkyl groups having a carbon number of 4 or less such as methyl, ethyl and propyl, alkoxy groups having a carbon number of 4 or less such as methoxy and ethoxy, hydroxyl groups, carboxyl groups, alkoxycarbonyl groups having a carbon number of 4 or less such as ethoxycarbonyl, substituted alkyl groups such as trifluoromethyl, benzyl and phenethyl, aryl groups such as phenyl and substituted aryl groups such as p-tolyl.

$R_1$ and $R_2$ independently represent an aliphatic group having a carbon number of 8 or less, including saturated and unsaturated aliphatic hydrocarbons, wherein the carbon chain may be interrupted by a hetero atom such as an oxygen, sulfur or nitrogen atom. These aliphatic groups may have a substituent, such as a hydroxyl group, alkoxy group, alkylcarbonyloxy group, phenyl group, substituted phenyl group, carboxyl group or sulfo group. At least one of $R_1$ and $R_2$ has a carboxyl group or sulfo group. When both of $R_1$ and $R_2$ have a carboxyl group or sulfo group, one of them may form a salt with a cation such as an alkali metal ammonium ion or organic base onium ion.

With respect to Formula II, the rings (nuclei) for $Z_3$ and $Z_4$ may have a substituent in addition to $R_3$ or $R_4$ on the nitrogen atom. Examples of the substituent include halogen atoms such as chlorine, bromine and fluorine atoms, alkyl groups having a carbon number of 4 or less such as methyl, ethyl and propyl, alkoxy groups having a carbon number of 4 or less such as methoxy and ethoxy, hydroxyl groups, carboxyl groups, alkoxycarbonyl groups having a carbon number of 4 or less such as ethoxycarbonyl, substituted alkyl groups such as trifluoromethyl, benzyl and phenethyl, aryl groups such as phenyl and substituted aryl groups such as p-tolyl.

$R_3$ and $R_4$ have the same definitions as $R_1$ and $R_2$ of Formula I; at least one of $R_3$ and $R_4$ represents an aliphatic group containing a carboxyl group or sulfo group.

The dyes represented by Formulas I and II are respectively known compounds and can easily be synthesized by those skilled in the art in accordance with U.S. Pat. Nos. 3,149,105 and 2,238,231, British Patent No. 742,112 or "The Cyanine Dyes and Related Compounds", edited by F. M. Hamer, Interscience Publishers, New York (1964), pp. 55 and thereafter.

Typical examples of the sensitizing dyes represented by Formulas I and II for the present invention are given below.

I-1

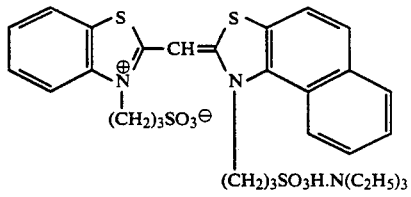

I-2

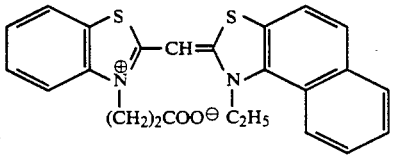

-continued

I-3

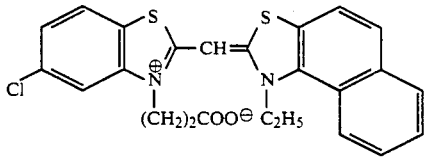

I-4

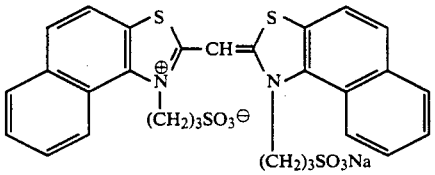

I-5

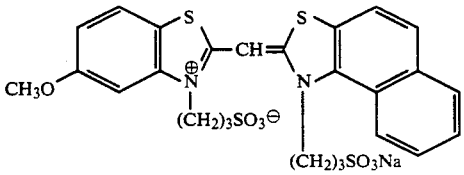

I-6

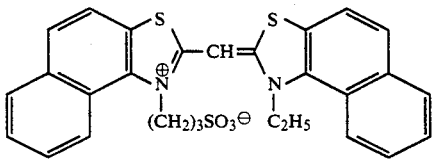

I-7

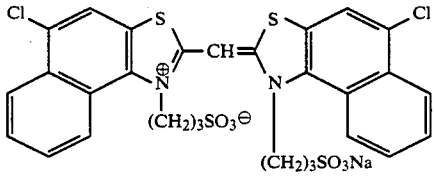

I-8

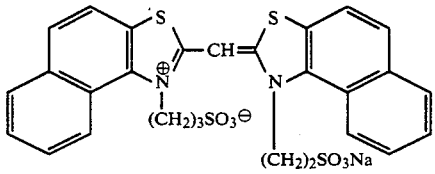

I-9

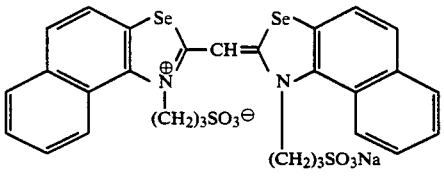

I-10

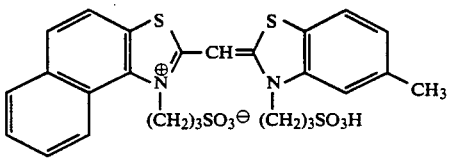

II-1

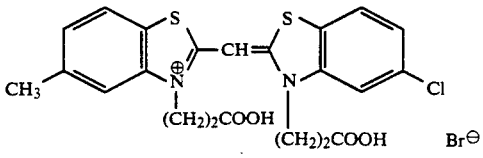

-continued

II-2

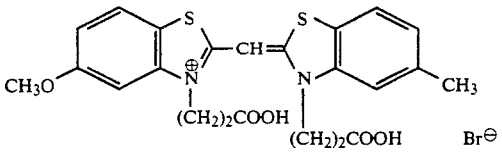

II-3

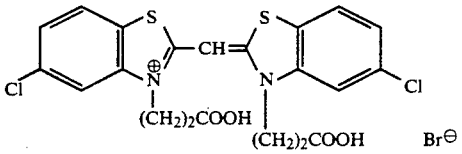

II-4

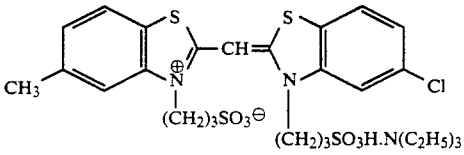

II-5

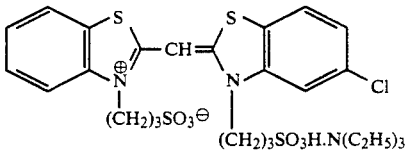

II-6

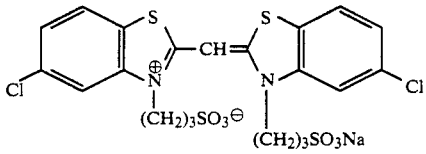

II-7

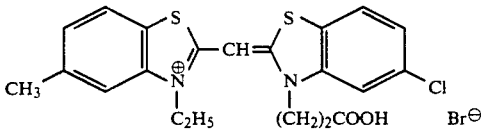

II-8

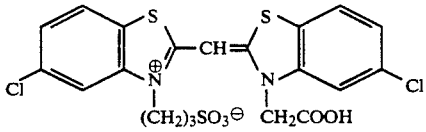

II-9

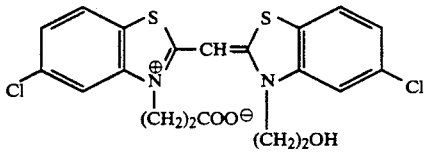

II-10

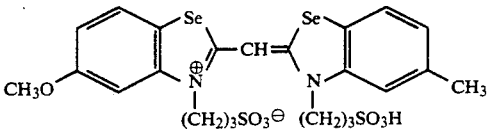

-continued

II-11

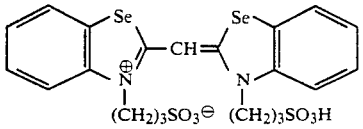

The optimum concentration of a sensitizing dye for the present invention can be determined by dividing the emulsion into some parts, adding the sensitizing dye in different concentrations to the respective parts and measuring the sensitivity of each part in accordance with a method known to those skilled in the art.

Although the amount of sensitizing dyes used for the present invention is not subject to limitation, it is advantageous to use the sensitizing dyes at about $2\times10^{-6}$ to $1\times10^{-3}$ mol, more advantageously about $5\times10^{-6}$ to $1\times10^{-4}$ mol per mol of silver halide in total. For the desired effect of the present invention, it is preferable that the amount ratio of the dye represented by Formula I and the dye represented by Formula II be 1:1.5 to 1:8, more advantageously 1:2 to 1:4.

The sensitizing dyes may be added to silver halide emulsion separately in arbitrary order or in a form of mixture.

The photographic emulsion according to the present invention may contain a sensitizing dye other than the dyes represented by Formulas I and II or a substantially colorless compound known to possess supersensitizing activity.

The dye forming couplers and other compounds in the silver halide photographic light-sensitive material of the present invention are added to the prescribed hydrophilic colloidal layer normally after being dissolved in a high boiling organic solvent having a boiling point exceeding about 150° C. along with a low boiling and/or water-soluble organic solvent added as necessary and subsequently dispersed in a hydrophilic binder such as an aqueous solution of gelatin in solution in the presence of a surfactant using a means of dispersion such as a stirrer, homogenizer, colloid mill, flow jet mixer or ultrasonic dispersion apparatus. A process may be added in which the low boiling organic solvent is removed after or simultaneously with dispersion.

Examples of the high boiling solvent include organic solvents having a boiling point of over 150° C. which do not react with the oxidation product of a developing agent, such as phenol derivatives, phthalates, phosphates, citrates, benzoates, alkylamides, fatty acid esters and trimesates.

With respect to the silver halide color photographic light-sensitive material of the present invention, the silver halide grains contained in at least one silver halide emulsion layer preferably comprise silver chloride or silver chlorobromide which is substantially free of silver iodide and which has a silver chloride content of not less than 90 mol. %.

For the desired effect of the present invention, the silver chloride content preferably ranges from not less than 95 mol. %, more preferably not less than 98 mol. % to 99.9 mol. %. "Being substantially free of silver iodide" means that the silver chloroiodobromide has a silver iodide content of not more than 0.5 mol. %, with preference given to silver chlorobromide, which contains no silver iodide. Accordingly, silver chlorobromide having a silver bromide content of 0.1 to 2 mol. % is preferably used for the present invention.

The silver halide emulsion of the present invention may comprise grains with a uniform composition or a mixture of silver halide grains with different compositions. As long as the desired effect of the present invention is not degraded, the silver halide emulsion of the invention may be used in mixture with silver halide grains having a silver chloride content of not more than 90 mol. %.

In the silver halide emulsion layer of the present invention, which contains silver halide grains having a silver chloride content of not less than 90 mol. %, the silver halide grains having a silver chloride content of not less than 90 mol. % account for not less than 60 wt. %, preferably not less than 80 wt. % of all silver halide grains contained in the emulsion layer.

As for the composition of the silver halide grains of the present invention, there may be a number of phases with different silver bromide contents therein or it may be uniform from the core to shell of the grains.

Although the grain size of the silver halide grains for the present invention is not subject to limitation, it is preferable in view of other photographic properties that the grain size be 0.2 to 1.6 μm, more preferably 0.25 to 1.2 μm.

The distribution of silver halide grain size may be polydispersed or monodispersed, with preference given to monodispersed silver halide grains wherein the coefficient of variance in the grain size distribution of silver halide grains is not more than 0.22, more preferably not more than 0.15.

Here, the coefficient of variance is the ratio $\sigma/\bar{r}$ of the standard deviation $\sigma$ and the average grain size $\bar{r}$.

In the present invention, the silver halide grains used in emulsion may be prepared by any of the acid method, neutral method and ammoniacal method. The grains may be grown immediately or after forming seed grains.

The silver halide grains for the present invention may take any shape. A preferred mode of the shape is a cube having {100} planes on the crystal. Octahedral, tetradecahedral, dodecahedral and other shapes of grains may also be used. Grains having twin planes may also be used.

The silver halide emulsion of the present invention may be supplemented with a compound known as antifogging agent or stabilizer for the purpose of optimizing chemical sensitization or preventing sensitivity reduction or fogging during storage or development of the light-sensitive material.

Such compounds include 4-hydroxy-6-methyl-1,3,3a,7-tetrazaindene, 3-methylbenzothiazole, 1-phenyl-5-mercaptotetrazole and other heterocyclic compounds and mercapto compounds, with preference given to the mercapto compound represented by the following Formula S.

Formula S

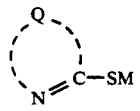

wherein Q represents a group of atoms necessary for the formation of a 5- or 6-membered heterocyclic ring or a benzene-condensed 5- or 6-membered heterocyclic ring; M represent a hydrogen atom or cation.

In Formula S, Q is a group of atoms necessary for forming a five- or six-membered heterocycle or a five- or six-membered heterocycle condensed with a benzene ring. The heterocycle formed by Q is, for example, a ring of imidazole, tetrazole, thiazole, oxazole, selenazole, benzimidazole, naphthimidazole, benzothiazole, naphthothiazole, benzoselenazole, naphthoselenazole or benzoxazole. A cation represented by M is, for example, an alkali metal such as sodium and potassium, or an ammonium group.

Among mercapto compounds represented by Formula S, compounds represented by Formula SA, SB, SC or SD are preferable.

Formula SA

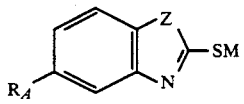

wherein $R_A$ represents a hydrogen atom, alkyl group, alkoxy group, aryl group, halogen atom, carboxyl group or its salt, sulfo group or its salt or amino group; Z represents —NH—, —O— or —S—; M has the same definition as in Formula S.

Formula SB

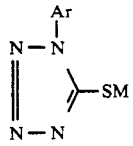

wherein $A_r$ represents

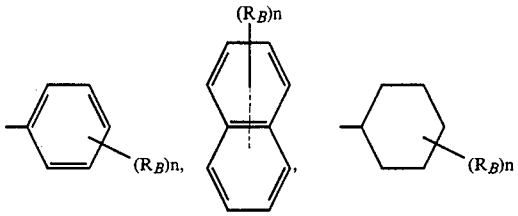

wherein $R_B$ represents an alkyl group, alkoxy group, carboxyl group or its salt, sulfo group or its salt, hydroxyl group, amino group, acylamino group, carbamoyl group or sulfonamido group; n represents an integer of 0 to 2; M has the same definition as in Formula S.

With respect to Formulas SA and SB, the alkyl groups represented by $R_A$ and $R_B$ are exemplified by a methyl group, ethyl group and butyl group; the alkoxy groups are exemplified by a methoxy group and ethoxy group; the salts of carboxyl group or sulfo group are exemplified by sodium salt and ammonium salt.

With respect to Formula SA, the aryl group represented by $R_A$ is exemplified by a phenyl group and naphthyl group; the halogen atom is exemplified by a chlorine atom and bromine atom.

With respect to Formula SB, the acylamino group represented by $R_B$ is exemplified by a methylcarbonylamino group and benzoylamino group; the carbamoyl group is exemplified by an ethylcarbamoyl group and phenylcarbamoyl group; the sulfonamide group is exemplified by a methylsulfonamide group and phenylsulfonamide group.

The alkyl groups, alkoxy groups, aryl groups, amino groups, acylamino groups, carbamoyl groups, sulfonamide groups and other groups described above include those having an additional substituent.

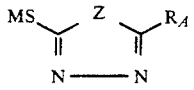

wherein Z represents a

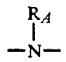

group, oxygen atom or sulfur atom; $R_A$ represents a hydrogen atom, alkyl group, aryl group, alkenyl group, cycloalkyl group, $—SR_{A1}$,

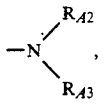

$—NHCOR_{A4}$, $—NHSO_2R_{A5}$ or heterocyclic group; $R_{A1}$ represents a hydrogen atom, alkyl group, alkenyl group, cycloalkyl group, aryl group, $—COR_{A4}$ or $—SO_2R_{A5}$; $R_{A2}$ and $R_{A3}$ independently represent a hydrogen atom, alkyl group or aryl group; $R_{A4}$ and $R_{A5}$ independently represent an alkyl group or aryl group; M has the same definition as in Formula S.

The alkyl groups represented by $R_A$, $R_{A1}$, $R_{A2}$, $R_{A3}$, $R_{A4}$ and $R_{A5}$ in Formula SC are exemplified by a methyl group, benzyl group, ethyl group and propyl group; the aryl groups are exemplified by a phenyl group and naphthyl group.

The alkenyl groups represented by $R_A$ and $R_{A1}$ are exemplified by a propenyl group; the cycloalkyl groups are exemplified by a cyclohexyl group.

The heterocyclic group represented by $R_A$ is exemplified by a furyl group and pyridinyl group.

The alkyl groups and aryl groups represented by $R_A$, $R_{A1}$, $R_{A2}$, $R_{A3}$, $R_{A4}$ and $R_{A5}$, the alkenyl groups and cycloalkyl groups represented by $R_A$ and $R_{A1}$ and the heterocyclic group grouped by $R_A$ include those having an additional substituent.

Formula SD

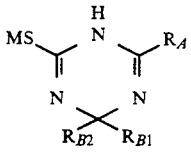

wherein $R_A$ and M respectively have the same definitions as $R_A$ and M in Formula SC. $R_{B1}$ and $R_{B2}$ respectively have the same definitions as $R_{A1}$ and $R_{A2}$ in Formula SC.

Examples of the compound represented by Formula S are given below.

SA-1

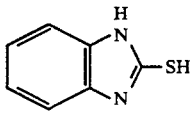

SA-2

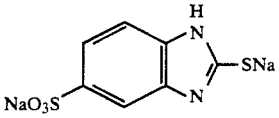

-continued

SA-3

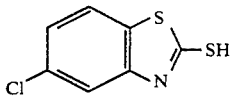

SA-4

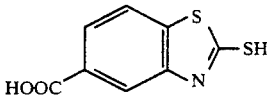

SA-5

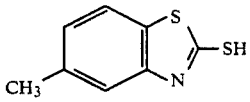

SA-6

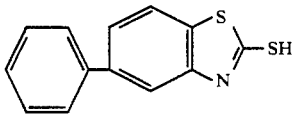

SA-7

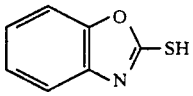

SA-8

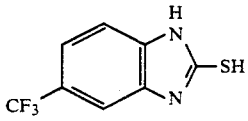

SB-1

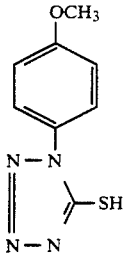

SB-2

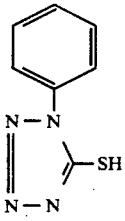

SB-3

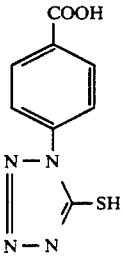

-continued
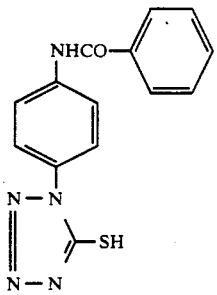
SB-4
-continued
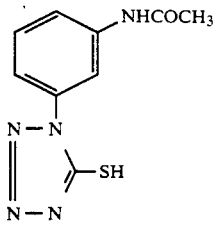
SB-5
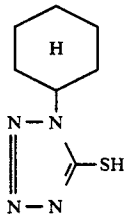
SB-6
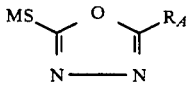
| Exemplified Compound | $R_A$ | M |
|---|---|---|
| SC-1 | $-C_2H_5$ | —H |
| SC-2 | $-CH_2-CH=CH_2$ | —H |
| SC-3 | $-CH=CH-CH_2-CH_3$ | —H |
| SC-4 | $-C_7H_{15}$ | —H |
| SC-5 | $-C_9H_{19}$ | —Na |
| SC-6 | 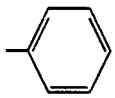 | —H |
| SC-7 | $-C_4H_9(t)$ | —H |
| SC-8 | 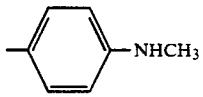  | —H |
| SC-9 | 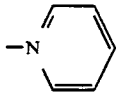  | —H |
| SC-10 | 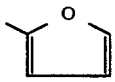  | —H |
| SC-11 | 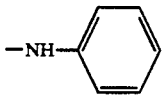  | —H |
| SC-12 | 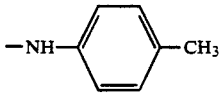  | $-NH_4$ |
| SC-13 | $-NHCOCH_3$ | —H |
| Exemplified Compound | R | M |
|---|---|---|

-continued
| | | |
|---|---|---|
| SC-14 | 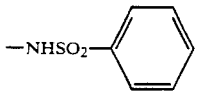 | —H |
| SC-15 | $-N(CH_3)_2$ | —H |
| SC-16 | 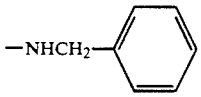 | —H |
| SC-17 | 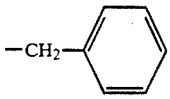 | —H |
| SC-18 | $-S-CH_3$ | —H |
| SC-19 | 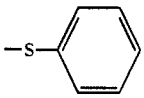 | —H |
| SC-20 | —SH | —H |
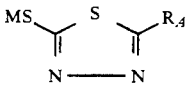
| Exemplified Compound | $R_A$ | M |
|---|---|---|
| SC-21 | —H | —H |
| SC-22 | $-C_2H_5$ | —H |
| SC-23 | $-C_4H_{9(t)}$ | —H |
| SC-24 | $-C_6H_{13}$ | —H |
| SC-25 | 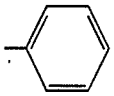 | —H |
| SC-26 | 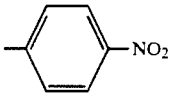 | —H |
| SC-27 | 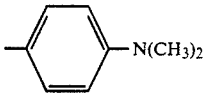 | —H |
| SC-28 | 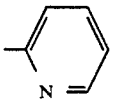 | —H |
| SC-29 | 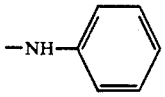 | —H |
| SC-30 | $-NH_2$ | —H |
| SC-31 | $-CH_2CH=CH_2$ | —H |
| SC-32 | —SH | —H |
| SC-33 | $-NHCOC_2H_5$ | —H |
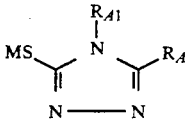

-continued
| Exemplified Compound | $R_A$ | $R_{A1}$ | M |
|---|---|---|---|
| SC-34 | $-C_2H_5$ | $-H$ | $-H$ |
| SC-35 | $-CH_3$ | $-CH_3$ | $-H$ |
| SC-36 | $-CH_3$ | 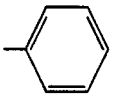 | $-H$ |
| SC-37 | $-NHCOCH_3$ | $-CH_3$ | $-H$ |
| SC-38 | 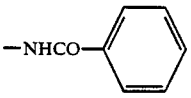 | 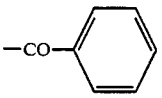 | $-H$ |
| SC-39 | $-NHCOCH_3$ | $-COCH_3$ | $-H$ |
| SC-40 | $-NHCOCH_3$ | 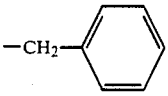 | $-H$ |
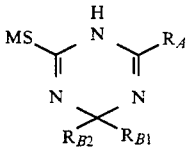
| Exemplified Compound | $R_A$ | $R_{B1}$ | $R_{B2}$ | M |
|---|---|---|---|---|
| SD-1 | $-C_2H_5$ | $-CH_3$ | $-CH_3$ | $-H$ |
| SD-2 | 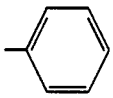 | $-CH_3$ | $-CH_3$ | $-H$ |
| SD-3 | $-NH_2$ | $-H$ | 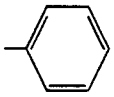 | $-H$ |
| SD-4 | 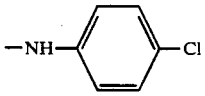 | $-H$ | $-C_4H_9$ | $-H$ |
| SD-5 | $-NHCOCH_3$ | $-CH_3$ | $-CH_3$ | $-H$ |
| SD-6 | 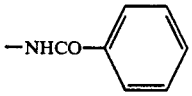 | $-CH_3$ | $-CH_3$ | $-H$ |
| SD-7 | 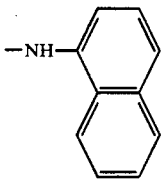 | $-CH_3$ | $-C_3H_7(i)$ | $-H$ |

-continued

SD-8

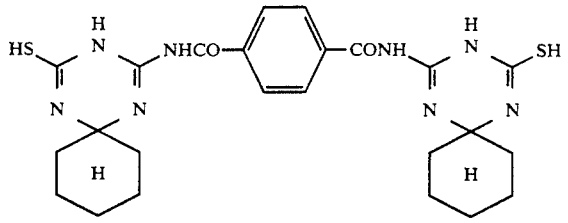

The compounds represented by Formula S include the compounds described in Japanese Patent Examined Publication No. 28496/1965, Japanese Patent O.P.I. Publication No. 89034/1975, the Journal of Chemical Society, 49, 1748 (1927) and 4237 (1952), the Journal of Organic Chemistry, 39, 2469 (1965), US Patent No. 2,824,001, the Journal of Chemical Society, 1723 (1951), Japanese Patent O.P.I. Publication No. 111846/1981, British Patent No. 1,275,701, U.S. Pat. Nos. 3,266,897 and 2,403,927 and other publications, and can be synthesized in accordance with the methods described in these references.

When the silver halide photographic light-sensitive material of the present invention is a multiple color light-sensitive material, the specific layer configuration is preferably such that a yellow dye image forming layer, an interlayer, a magenta dye image forming layer, an interlayer, a cyan dye image forming layer, an interlayer and a protective layer are laminated on the support in this order from the support side.

The dye image forming coupler for light-sensitive material of the present invention is not subject to limitation, affording the use of various couplers, but the compounds described in the following patents are typically used.

The yellow dye image forming coupler is of the acylacetamide type or benzoylmethane type. Examples thereof are given in U.S. Pat. Nos. 2,778,658, 2,875,057, 2,908,573, 2,908,513, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322 and 3,725,072, German Patent Nos. 1,547,868, 2,057,941, 2,162,899, 2,163,812, 2,213,461, 2,219,917, 2,261,361 and 2,263,875, Japanese Patent Examined Publication No. 13576/1974, Japanese Patent O.P.I. Publication Nos. 29432/1973, 66834/1973, 10736/1974, 122335/1974, 28834/1975, 132926/1975, 144240/1980 and 87041/1981 and other publications.

The magenta dye image forming coupler is a 5-pyrazolone, pyrazolotriazole, pyrazolinobenzimidazole, indazolone or cyanoacetyl series magenta dye image forming coupler. Examples thereof are given in U.S. Pat. Nos. 2,600,788, 3,061,432, 3,062,653, 3,127,269, 3,311,476, 3,152,896, 3,419,391, 3,519,429, 3,558,318, 3,684,514, 3,705,896, 3,888,680, 3,907,571, 3,928,044, 3,930,861, 3,930,816 and 3,933,500, Japanese Patent O.P.I. Publication Nos. 29639/1974, 111631/1974, 129538/1974, 112341/1976, 58922/1977, 62454/1980, 118034/1980, 38643/1981 and 135841/1981, Japanese Patent Examined Publication Nos. 60479/1971, 34937/1977, 29421/1980 and 35696/1980, British Patent No. 1,247,493, Belgian Patent No. 792,525, West German Patent No. 2,156,111, Japanese Patent Examined Publication No. 60479/1971, Japanese Patent O.P.I. Publication Nos. 125732/1984, 228252/1984, 162548/1984, 171956/1984, 33552/1985 and 43659/1985, West German Patent No. 1,070,030, U.S. Pat. No. 3,725,067 and other publications.

The cyan dye image forming coupler is typically exemplified by phenol and naphthol series cyan dye image forming coupler. Examples thereof are given in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044, British Patent Nos. 478,991, 945,542, 1,084,480, 1,377,233, 1.388,024 and 1,543,040, Japanese Patent O.P.I. Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, 32071/1980, 146050/1984, 31953/1984 and 117249/1985 and other publications.

These dye forming couplers desirably have a ballast group which has a carbon number of not less than 8 and which makes the couplers non-diffusible. Also, it is no matter whether these dye forming couplers are 4-equivalent, in which four silver ions must be reduced to form one dye molecule, or 2-equivalent, in which two silver ions must be reduced.

Although it is advantageous to use gelatin as a binder or protective colloid for the silver halide photographic light-sensitive material of the present invention, hydrophilic colloids such as gelatin derivatives, graft polymers formed between gelatin and another polymer, proteins, sugar derivatives, cellulose derivatives and synthetic hydrophilic homo- or copolymers can also be used.

The silver halide photographic light-sensitive material of the present invention may contain a water-soluble dye, antifogging agent, an image stabilizer, a hardener, a plasticizer, a polymer latex, an ultraviolet absorbent, a formalin scavenger, a mordant, a developing accelerator, a developing retarder, a fluorescence brightening agent, a matting agent, a lubricant, an antistatic agent and a surfactant.

The photographic structural layer of the silver halide color photographic light-sensitive material of the present invention can be coated on flexible reflective supports such as baryta paper, paper laminated with α-olefin polymer etc., paper supports from which the α-olefin layer is easily removable and synthetic paper, reflective supports prepared by adding or applying a white pigment to a film of semisynthetic or synthetic polymer such as cellulose acetate, cellulose nitrate, polystyrene, polyvinyl chloride, polyethylene terephthalate, polycarbonate or polyamide, and rigid materials such as metals and porcelain. A thin reflective support of 120 to 160 μm in thickness can also be used.

Inorganic and/or organic white pigments can be used, with preference given to inorganic white pigments. Examples thereof include alkaline earth metal sulfates such as barium sulfate, alkaline earth metal carbonates such as calcium carbonate, silica compounds such as synthetic silicates, calcium silicate, alumina, alumina hydrate, titanium oxide, zinc oxide, talc and clay. The white pigment is preferably barium sulfate and titanium oxide.

The silver halide photographic light-sensitive material of the present invention may be coated on the support directly or via an under-coating layer which comprises one or more under-coating layers for improving the adhesion, antistatic property, dimensional stability, friction resistance, hardness, anti-halation property, tribological property and/or other properties of the surface of the support, after the surface of the support is subjected to corona discharge, ultraviolet irradiation, flaming and other treatments as necessary.

In coating a photographic light-sensitive material incorporating the silver halide emulsion of the present invention, a thickener may be used to improve the coatability. The particularly useful coating methods are extrusion coating and curtain coating, both of which permit simultaneous coating of two or more layers.

The silver halide photographic light-sensitive material of the present invention is capable of forming an image by a developing process known to those skilled in the art. Concerning color developing, the color developing agent used in the color developer for the present invention includes aminophenol and p-phenylenediamine derivatives which are widely used in various:color photographic processes.

To the color developer used to process the silver halide photographic light-sensitive material of the present invention, a known developer component compound may be added in addition to the primary aromatic amine based color developing agent described above.

The pH of color developer is normally not less than 7, most commonly 10 to 13.

The color developer temperature is normally over 15° C., commonly in the range of from 20° to 50° C. For rapid developing, it is preferable to process the light-sensitive material at over 30° C. The color developing time in rapid processing is preferably within 120 seconds, more preferably within 90 seconds, although it is 3 to 4 minutes in conventional processes.

The silver halide photographic light-sensitive material of the present invention is subjected to bleaching and fixation after developing. Bleaching may be conducted simultaneously with fixation.

Fixation is normally followed by washing. Also, washing may be replaced with stabilization, and they may be conducted in combination.

EXAMPLES

Example 1

To 1000 ml of a 2% aqueous solution of gelatin held at 40° C., the following Solutions A and B were simultaneously added over a period of 30 minutes while maintaining a pAg of 6.5 and a pH of 3.0, after which the following Solutions C and D were simultaneously added over a period of 120 minutes while maintaining a pAg of 7.3 and a pH of 5.5.

pAg was regulated by the method described in Japanese Patent O.P.I. Publication No. 45437/1984, and pH was regulated using sulfuric acid or an aqueous solution of sodium hydroxide.

| | |
|---|---|
| Solution A | |
| Sodium chloride | 3.27 g |
| Potassium bromide | 0.35 g |
| Water was added to make a total quantity of 200 ml. | |
| Solution B | |
| Silver nitrate | 10 g |
| Water was added to make a total quantity of 200 ml. | |
| Solution C | |
| Sodium chloride | 98.1 g |
| Potassium bromide | 10.5 g |
| Water was added to make a total quantity of 600 ml. | |
| Solution D | |
| Silver nitrate | 300 g |
| Water was added to make a total quantity of 600 ml. | |

After completion of the addition, the mixture was desalted with a 5% aqueous solution of Demol N, a product of Kao Atlas, and a 20% aqueous solution of magnesium sulfate and then mixed with an aqueous solution of gelatin to yield a monodispersed emulsion EMP-A comprising cubic grains having an average grain size of 0.6 μm, a coefficient of variance of 0.07 and a silver chloride content of 95 mol. %.

An emulsion EMP-B was prepared in the same manner as with EMP-A except that 0.019 mg of potassium hexachloroiridate was added to the Solution C.

An emulsion EMP-C was prepared in the same manner as with EMP-B except that 3 mg of potassium hexacyanoferrate (II) trihydrate was added to the Solution C, namely potassium hexachloroiridate and potassium hexacyanoferrate trihydrate were added to the Solution C.

The emulsions EMP-B and EMP-C, like EMP-A, were both monodispersed emulsions comprising cubic grains having an average grain size of 0.6 μm and a coefficient of variance of 0.07.

The emulsion EMP-A was optimally sensitized with the following compounds at 65° C. to yield a blue-sensitive silver halide emulsion Em-Al.

Sodium thiosulfate 1.0 mg/mol AgX
Stabilizer SB-5 $6\times10^{-4}$ mol/mol AgX
Sensitizing dye II-8 $4\times10^{-4}$ mol/mol AgX The emulsion EMP-A was optimally sensitized with the following compounds at 65° C. to yield a blue-sensitive silver halide emulsion Em-A2.

Sodium thiosulfate 1.0 mg/mol AgX
Chloroauric acid 0.8 mg/mol AgX
Stabilizer SB-5 $6\times10^{-4}$ mol/mol AgX
Sensitizing dye II-8 $4\times10^{-4}$ mol/mol AgX The emulsion EMP-A was optimally sensitized with the following compounds at 65° C. to yield a blue-sensitive silver halide emulsion Em-A3.

Sodium thiosulfate 1.0 mg/mol AgX
Chloroauric acid 0.8 mg/mol AgX
Stabilizer SB-5 $6\times10^{-4}$ mol/mol AgX
Sensitizing dye II-8 $4\times10^{-4}$ mol/mol AgX
Elemental sulfur (α-sulfur) 0.5 mg/mol AgX The emulsion EMP-B was optimally sensitized with the same compounds as with Em-Al at 65° C. to yield a blue-sensitive silver halide emulsion Em-B1.

The emulsion EMP-B was optimally sensitized with the same compounds as with Em-A2 at 65° C. to yield a blue-sensitive silver halide emulsion Em-B2.

The emulsion EMP-B was optimally sensitized with the same compounds as with Em-A3 at 65° C. to yield a blue-sensitive silver halide emulsion Em-B3.

The emulsion EMP-C was optimally sensitized with the same compounds as with Em-A1at 65° C. to yield a blue-sensitive silver halide emulsion Em-C1.

The emulsion EMP-C was optimally sensitized with the same compounds as with Em-A2 at 65° C. to yield a blue-sensitive silver halide emulsion Em-C2.

The emulsion EMP-C was optimally sensitized with the same compounds as with Em-A3 at 65° C. to yield a blue-sensitive silver halide emulsion Em-C3.

Table 1 lists the emulsions obtained in the same manner as with the emulsions Em-A1, A2, A3, B1, B2, B3, C1, C2 and C3 except that a sensitizing dye of Formula I was used in combination with the sensitizing dye II-8 and the stabilizer SB-5 was replaced with Z-1. Each of the sensitizing dyes of Formula I was used in the amount of $4.5\times10^{-5}$ mol/mol of silver halide. Sensitizing dye II-8 and the sensitizing dye of Formula I were added to the silver halide emulsion simultaneously.

Z-1 was 4-hydroxy-6-methyl-1,3,3a,7-tetrazaindene.

After adding 0.4 mol of a dispersed yellow coupler per mol of the spectrally sensitized silver chlorobromide emulsion and a coating aid sodium dodecylbenzenesulfonate, the emulsion was coated on a paper support coated with polyethylene containing titanium oxide to an amount of silver coated of 0.35 g/m$^2$. Gelatin was further coated thereon to form a protective layer so that the coating amount was 4.0 g/m$^2$.

The samples thus obtained were evaluated as follows:

(1) Sensitometry

The sample was exposed to white light through an optical wedge for 0.05 second and developed in the following processes, after which the blue, green and red densities were determined through blue, green and red filters using an optical densitometer PDA-65 model, produced by Konica Corporation. The sensitivity is expressed for the reciprocal of the exposure amount necessary to obtain a density higher by 0.8 than the fogging density. The degree of fogging was determined by measuring the density in the unexposed portion.

(2) Reciprocity law failure property

The sample was subjected to exposure through an optical wedge for 10 seconds so that the exposure amount was equal to that in the sensitometry above, after which it was subjected to sensitometry in the same manner as above. The reciprocity law failure property is expressed as the percent sensitivity of the sample subjected to exposure for 10 seconds, relative to the sensitivity of the sample subjected to exposure for 0.05 second. As the value approaches 100, the reciprocity law failure property improves.

(3) Humidity dependency in exposure

Sensitometry was performed in the same manner as above except that exposure was made at relative humidities of 10% and 60% with the temperature kept constant at 25° C. The humidity dependency is expressed as the percent sensitivity of the sample tested at a relative humidity of 50%, relative to the sensitivity of the sample tested at a relative humidity of 10%. As the obtained value approaches 100, the fluctuation of sensitivity upon humidity change decreases favorably.

The results obtained are given in Table 1.

| Procedures | Temperature | Processing time |
|---|---|---|
| Color developing | 35 ± 0.3° C. | 45 seconds |
| Bleach-fixation | 35 ± 0.5° C. | 45 seconds |
| Stabilization | 30–34° C. | 90 seconds |
| Drying | 60–80° C. | 60 seconds |

| Color developer | |
|---|---|
| Pure water | 800 ml |
| Triethanolamine | 10 g |
| N,N-diethylhydroxylamine | 10 g |
| Potassium chloride | 2 g |
| Potassium sulfite | 0.3 g |
| 1-hydroxyethylidene-1,1-diphosphonic acid | 1.0 g |
| Ethylenediaminetetraacetic acid | 1.0 g |
| Disodium catechol-3,5-disulfonate | 1.0 g |
| N-ethyl-N-β-methanesulfonamidoethyl-3-methyl-4-aminoaniline sulfate | 4.5 g |
| Brightening agent: | |
| 4,4'-diaminostylbenedisulfonic acid derivative | 1.0 g |

Water was added to make a total quantity of 1l, and the pH was adjusted to 10.10.

| Bleach-fixer | |
|---|---|
| Ferric ammonium ethylenediaminetetraacetate dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |

Water was added to make a total quantity of 1l, and potassium carbonate or glacial acetic acid was added to obtain a pH of 6.2.

| Stabilizer | |
|---|---|
| 5-chloro-2-methyl-4-isothiazolin-3-one | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide (20% aqueous solution) | 3.0 g |
| Ammonium sulfite | 3.0 g |
| Brightening agent: | |
| 4,4'-diaminostylbenedisulfonic acid derivative | 1.5 g |

Water was added to make a total quantity of 1l, and sulfuric acid or potassium hydroxide was added to obtain a pH of 7.0.

TABLE 1

| Sample number | Emulsion number | Sensitizing dye I | Stabilizer a | Stabilizer b | Sensitivity | Fogging | Reciprocity law failure (%) | Humidity dependency (%) |
|---|---|---|---|---|---|---|---|---|
| 1 (comparative) | Em-A1 | — | SB-5 | — | 100 | 0.04 | 62 | 92 |
| 2 (comparative) | Em-A1 | I-3 | SB-5 | — | 103 | 0.04 | 63 | 96 |
| 3 (comparative) | Em-A1 | I-5 | SB-5 | — | 106 | 0.05 | 59 | 95 |
| 4 (comparative) | Em-A1 | I-5 | — | Z-1 | 104 | 0.08 | 63 | 95 |
| 5 (comparative) | Em-A2 | — | SB-5 | — | 141 | 0.12 | 68 | 90 |
| 6 (comparative) | Em-A2 | I-3 | SB-5 | — | 140 | 0.13 | 67 | 91 |
| 7 (comparative) | Em-A2 | I-5 | SB-5 | — | 133 | 0.13 | 67 | 90 |
| 8 (comparative) | Em-A2 | I-5 | — | Z-1 | 143 | 0.19 | 65 | 93 |
| 9 (comparative) | Em-A3 | — | SB-5 | — | 132 | 0.05 | 58 | 81 |
| 10 (comparative) | Em-A3 | I-3 | SB-5 | — | 134 | 0.04 | 66 | 82 |
| 11 (comparative) | Em-A3 | I-5 | SB-5 | — | 129 | 0.04 | 65 | 83 |
| 12 (comparative) | Em-A3 | I-5 | — | Z-1 | 132 | 0.08 | 64 | 83 |

TABLE 1-continued

| Sample number | Emulsion number | Sensitizing dye I | Stabilizer a | Stabilizer b | Sensitivity | Fogging | Reciprocity law failure (%) | Humidity dependency (%) |
|---|---|---|---|---|---|---|---|---|
| 13 (comparative) | Em-B1 | — | SB-5 | — | 91 | 0.04 | 73 | 90 |
| 14 (comparative) | Em-B1 | I-3 | SB-5 | — | 93 | 0.04 | 74 | 95 |
| 15 (comparative) | Em-B1 | I-5 | SB-5 | — | 95 | 0.04 | 68 | 95 |
| 16 (comparative) | Em-B1 | I-5 | — | Z-1 | 95 | 0.07 | 73 | 94 |
| 17 (comparative) | Em-B2 | — | SB-5 | — | 130 | 0.12 | 78 | 89 |
| 18 (comparative) | Em-B2 | I-3 | SB-5 | — | 128 | 0.13 | 77 | 90 |
| 19 (comparative) | Em-B2 | I-5 | SB-5 | — | 124 | 0.12 | 79 | 90 |
| 20 (comparative) | Em-B2 | I-5 | — | Z-1 | 121 | 0.18 | 76 | 93 |
| 21 (comparative) | Em-B3 | — | SB-5 | — | 128 | 0.05 | 69 | 79 |
| 22 (comparative) | Em-B3 | I-3 | SB-5 | — | 122 | 0.04 | 76 | 80 |
| 23 (comparative) | Em-B3 | I-5 | SB-5 | — | 119 | 0.04 | 74 | 82 |
| 24 (comparative) | Em-B3 | I-5 | — | Z-1 | 120 | 0.07 | 74 | 81 |
| 25 (comparative) | Em-C1 | — | SB-5 | — | 98 | 0.04 | 83 | 91 |
| 26 (comparative) | Em-C1 | I-3 | SB-5 | — | 100 | 0.04 | 84 | 93 |
| 27 (comparative) | Em-C1 | I-5 | SB-5 | — | 105 | 0.06 | 80 | 94 |
| 28 (comparative) | Em-C1 | I-5 | — | Z-1 | 104 | 0.09 | 83 | 93 |
| 29 (comparative) | Em-C2 | — | SB-5 | — | 140 | 0.10 | 88 | 87 |
| 30 (comparative) | Em-C2 | I-3 | SB-5 | — | 141 | 0.14 | 85 | 88 |
| 31 (comparative) | Em-C2 | I-5 | SB-5 | — | 130 | 0.15 | 86 | 88 |
| 32 (comparative) | Em-C2 | I-5 | — | Z-1 | 144 | 0.19 | 87 | 90 |
| 33 (comparative) | Em-C3 | — | SB-5 | — | 131 | 0.06 | 79 | 73 |
| 34 (Inventive) | Em-C3 | I-3 | SB-5 | — | 133 | 0.05 | 88 | 95 |
| 35 (Inventive) | Em-C3 | I-5 | SB-5 | — | 129 | 0.04 | 86 | 94 |
| 36 (Inventive) | Em-C3 | I-5 | — | Z-1 | 130 | 0.08 | 86 | 96 |
| 37 (Inventive) | Em-C3 | I-4 | SB-5 | — | 134 | 0.03 | 90 | 98 |
| 38 (Inventive) | Em-C3 | I-6 | SB-5 | — | 130 | 0.03 | 82 | 95 |
| 39 (Inventive) | Em-C3 | I-8 | SB-5 | — | 132 | 0.04 | 83 | 94 |
| 40 (Inventive) | Em-C3 | I-9 | SB-5 | — | 128 | 0.05 | 87 | 95 |
| 41 (Inventive) | Em-C3 | I-10 | SB-5 | — | 131 | 0.04 | 82 | 95 |

Note:
All of Samples 1 to 34 each contained sensitizing dye II-8.

From Table 1, the following becomes evident.

When using the emulsions Em-A1 through A3, which are free of iridium, the reciprocity law failure property is poor. The emulsions Em-B1 through B3, which contain potassium hexachloroiridate alone, are subject to sensitivity reduction, though the reciprocity law failure property improves slightly. On the other hand, the emulsions Em-C1 through C-3, which incorporate a combination of potassium hexachloroiridate and potassium hexacyanoferrate (II) trihydrate showed an increased sensitivity and improved reciprocity law failure property in comparison with the emulsions Em-B1 through B3.

The emulsions Em-A2, Em-B2 and Em-C2, all of which were subjected to gold sensitization during chemical ripening, are very liable to fogging, though the sensitivity increases significantly in comparison with the emulsions Em-A1, Em-B1 and Em-C1, none of which was subjected to gold sensitization. On the other hand, the emulsions Em-A3, Em-B3 and Em-C3, all of which were subjected to gold sensitization in the presence of elemental sulfur during chemical ripening, were found more sensitive and less liable to fogging in comparison with the emulsions subjected to gold sensitization alone. However, the emulsions subjected to gold sensitization in the presence of inorganic sulfur show increased fluctuation of sensitivity upon humidity change, posing a problem in practical application.

In comparison with these samples, sample Nos. 34 through 41, prepared to have the configuration according to the present invention, are superior in sensitivity, fogging and reciprocity law failure property and shows markedly reduced fluctuation of sensitivity upon humidity change. This demonstrates that the use of a sensitizing dye in combination yields a light-sensitive material having generally excellent properties.

It was also found that the samples incorporating a stabilizer SB-5 to stop chemical ripening are preferred to the samples incorporating Z-1 instead for use as a light-sensitive material for prints since they have a stronger antifogging effect.

Example 2

Preparation of blue-sensitive silver halide emulsion

To 1000 ml of a 2% aqueous solution of gelatin held at 40° C., the following Solutions A and B were simultaneously added over a period of 30 minutes while maintaining a pAg of 6.5 and a pH of 3.0, after which the following Solutions C and D were simultaneously added over a period of 180 minutes while maintaining a pAg of 7.3 and a pH of 5.5.

pAg was regulated by the method described in Japanese Patent O.P.I. Publication No. 45437/1984, and pH was regulated using sulfuric acid or an aqueous solution of sodium hydroxide.

| | |
|---|---|
| Solution A | |
| Sodium chloride | 3.42 g |
| Potassium bromide | 0.03 g |
| Water was added to make a total quantity of 200 ml. | |
| Solution B | |
| Silver nitrate | 10 mg |
| Water was added to make a total quantity of 200 ml. | |
| Solution C | |
| Sodium chloride | 102.7 g |
| Potassium bromide | 1.0 g |
| Water was added to make a total quantity of 600 ml. | |
| Solution D | |
| Silver nitrate | 300 g |
| Water was added to make a total quantity of 600 ml. | |

After completion of the addition, the mixture was desalted with a 5% aqueous solution of Demol N, a product of Kao Atlas, and a 20% aqueous solution of magnesium sulfate and then mixed with an aqueous solution of gelatin to yield a monodispersed emulsion EMP-D comprising cubic grains having an average grain size of 0.85 μm, a coefficient of variance of 0.07 and a silver chloride content of 99.5 mol. %.

Emulsions EMP-E and EMP-F were prepared int he same manner as with EMP-B and EMP-C from EMP-A in Example 1 except that potassium hexachloroiridate was added to the Solution C for EMP-D to obtain EMP-E and potassium hexachloroiridate and potassium hexacyanoferrate (II) trihydrate were added to the Solution C to obtain EMP-F.

The emulsions EMP-E and EMP-F thus obtained were both monodispersed emulsions comprising cubic grains having an average grain size of 0.85 μm and a coefficient of variance of 0.07 like EMP-D.

The emulsion EMP-D was subjected to chemical ripening using 0.8 mg/mol AgX of sodium thiosulfate and $6\times10^{-4}$ mol/mol AgX of a stabilizer SB-5 at 50° C. for 90 minutes to yield a blue-sensitive silver halide emulsion Em-D1.

An emulsion Em-D2 was prepared in the same manner as with Em-D1 except that chloroauric acid was added at 0.8 mg/mol AgX.

An emulsion Em-D3 was prepared in the same manner as with Em-D2 except that 0.5 mg of elemental sulfur (α-sulfur) was added.

The emulsions EMP-E and EMP-F were also subjected to chemical ripening in the same manner as with EMP-D to yield emulsions Em-E1, E2, E3, F1, F2 and F3, respectively.

Table 2 lists the emulsions obtained in the same manner as with the emulsions Em-D1, D2, D3, E1, E2, E3, F1, F2 and F3 except that chemical ripening was conducted in the presence of two varied kinds of the sensitizing dyes listed in Table 2. Added amounts of sensitizing dye of Formula I and that of Formula II were $4\times10^{-5}$ mol and $4\times10^{-4}$ mol per mol of silver halide, respectively.

A monodispersed emulsion EMQ comprising cubic grains having an average grain size of 0.43 μm, a coefficient of variance of 0.08 and a silver chloride content of 99.5 mol. % was prepared in the same manner as with EMP-D except that the addition time for the Solutions A and B and the addition time for the Solutions C and D were changed.

EMQ was subjected to chemical ripening using the following compounds at 55° C. for 120 minutes to yield a green-sensitive silver halide emulsion EmQ.

Sodium thiosulfate 1.5 mg/mol AgX
Chloroauric acid 1.0 mg/mol AgX
Stabilizer SB-5 $6\times10^{-4}$ mol/mol AgX
Sensitizing dye D-2 $4\times10^{-4}$ mol/mol AgX Preparation of red-sensitive silver halide emulsion A monodispersed emulsion EMR comprising cubic grains having an average grain size of 0.50 μm, a coefficient of variance of 0.08 and a silver chloride content of 99.5 mol. % was prepared in the same manner as with EMP-D except that the addition time for the Solutions A and B and the addition time for the Solutions C and D were changed.

EMR was subjected to chemical ripening using the following compounds at 60° C. for 90 minutes to yield a red-sensitive silver halide emulsion EmR.

Sodium thiosulfate 1.8 mg/mol AgX
Chloroauric acid 2.0 mg/mol AgX
Stabilizer SB-5 $6\times10^{-4}$ mol/mol AgX
Sensitizing dye D-3 $8.0\times10^{-4}$ mol/mol AgX The sensitizing dyes D-2 and D-3 had the following structures:

D - 2

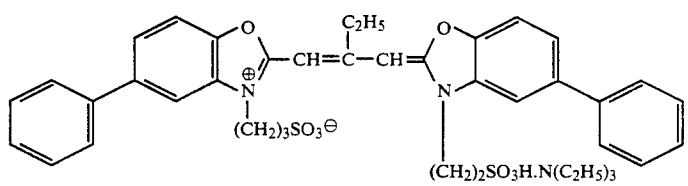

D - 3

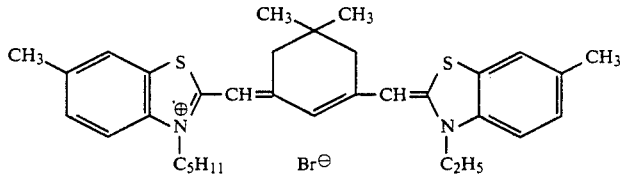

The following layers were coated on a paper support laminated with polyethylene on one face and polyethylene containing titanium oxide on the first layer side of the other face to yield a multiple layered silver halide color photographic light-sensitive material. Coating solutions were prepared as follows:

First layer coating solution 26.7 g of a yellow coupler Y-1, 10.0 g of a dye image stabilizer ST-1, 6.67 g of a dye image stabilizer ST-2, 0.67 g of an additive HQ-1 and 6.67 g of a high boiling organic solvent DNP were dissolved in 60 ml of ethyl acetate. This solution was emulsively:dispersed in 220 ml of a 10% aqueous solution of gelatin containing 7 ml of 20% surfactant SU-1 using an ultrasonic homogenizer to yield a yellow coupler dispersion. This dispersion was mixed with a blue-sensitive silver halide emulsion containing 10 g of silver prepared under the conditions shown below to yield a first layer coating solution.

Second through seventh coating solutions were prepared in the same manner as with the first layer coating solution.

Also added were hardeners H-1 to the second and fourth layers and H-2 to the seventh layer. As coating aids, surfactants SU-2 and SU-3 were added to adjust the surface tension.

| Layer | Composition | Amount of addition (g/m²) |
|---|---|---|
| Layer 7: | Antistaining agent HQ-2 | 0.002 |
| Protective | Antistaining agent HQ-3 | 0.002 |
| layer | Antistaining agent HQ-4 | 0.004 |

-continued

| Layer | Composition | Amount of addition ($g/m^2$) |
|---|---|---|
| | Antistaining agent HQ-5 | 0.02 |
| | DIDP | 0.005 |
| | Gelatin | 1.0 |
| | Antifungal agent F-1 | 0.002 |
| Layer 6: Ultraviolet absorbing layer | Gelatin | 0.4 |
| | UV absorbent UV-1 | 0.10 |
| | UV absorbent UV-2 | 0.04 |
| | UV absorbent UV-3 | 0.16 |
| | Antistaining agent HQ-5 | 0.04 |
| | DNP | 0.2 |
| | PVP | 0.03 |
| | Anti-irradiation dye AI-2 | 0.02 |
| Layer 5: Red-sensitive layer | Gelatin | 1.30 |
| | Red-sensitive silver chlorobromide emulsion EmR (as silver) | 0.21 |
| | Cyan coupler C-1 | 0.17 |
| | Cyan coupler C-2 | 0.25 |
| | Dye image stabilizer ST-1 | 0.20 |
| | Antistaining agent HQ-1 | 0.01 |
| | HBS-1 | 0.20 |
| | DOP | 0.20 |
| Layer 4: Ultraviolet absorbing layer | Gelatin | 0.94 |
| | UV absorbent UV-1 | 0.28 |
| | UV absorbent UV-2 | 0.09 |
| | UV absorbent UV-3 | 0.38 |
| | Antistaining agent HQ-5 | 0.10 |
| | DNP | 0.40 |

-continued

| Layer | Composition | Amount of addition ($g/m^2$) |
|---|---|---|
| Layer 3: Green-sensitive layer | Gelatin | 1.40 |
| | Green-sensitive silver chlorobromide emulsion EmQ (as silver) | 0.17 |
| | Magenta coupler M-1 | 0.23 |
| | Dye image stabilizer ST-3 | 0.20 |
| | Dye image stabilizer ST-4 | 0.17 |
| | DIDP | 0.13 |
| | DBP | 0.13 |
| | Anti-irradiation dye AI-1 | 0.01 |
| Layer 2: Interlayer | Gelatin | 1.20 |
| | Antistaining agent HQ-2 | 0.12 |
| | Antistaining agent HQ-3 | 0.03 |
| | Antistaining agent HQ-4 | 0.05 |
| | Antistaining agent HQ-5 | 0.23 |
| | DIDP | 0.15 |
| | Antifungal agent F-1 | 0.002 |
| Layer 1: Blue-sensitive layer | Gelatin | 1.20 |
| | Blue-sensitive silver chlorobromide emulsion EmP (as silver) | 0.26 |
| | Yellow coupler Y-1 | 0.80 |
| | Dye image stabilizer ST-1 | 0.30 |
| | Dye image stabilizer ST-2 | 0.20 |
| | Antistaining agent HQ-1 | 0.02 |
| | Anti-irradiation dye AI-3 | 0.01 |
| | DNP | 0.20 |
| Support | Polyethylene-laminated paper | |

M-1

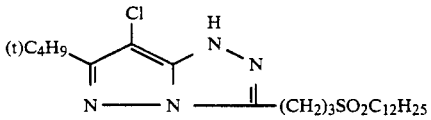

C-1

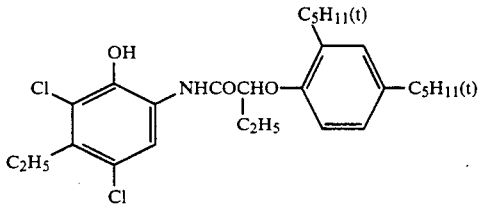

C-2

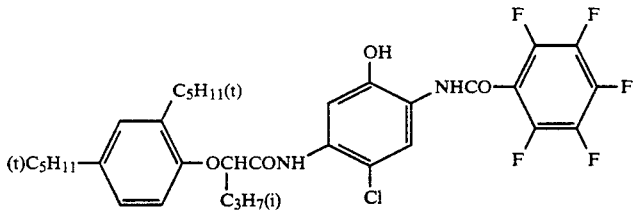

Y-1

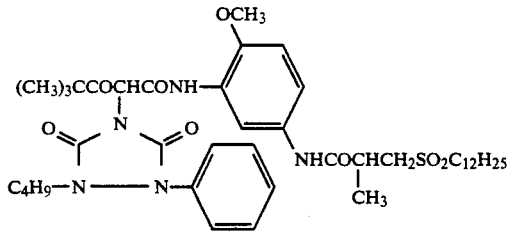

ST-1

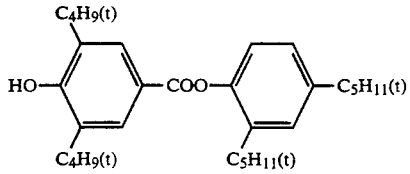

-continued
ST-2
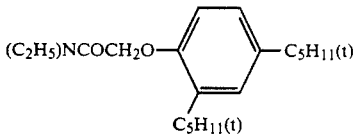
ST-3
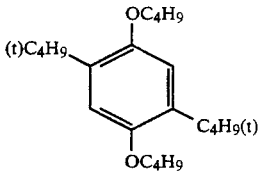
ST-4
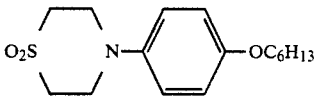
ST-5
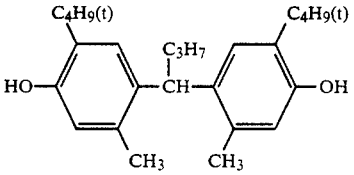
HQ-1
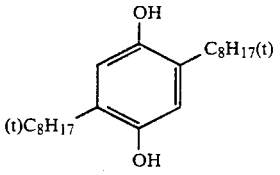
HQ-2
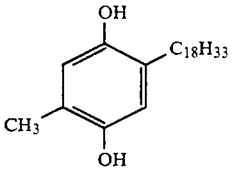
HQ-3
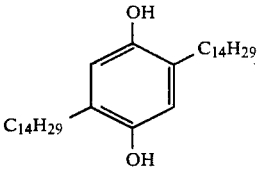
HQ-4
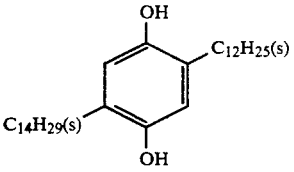
HQ-5
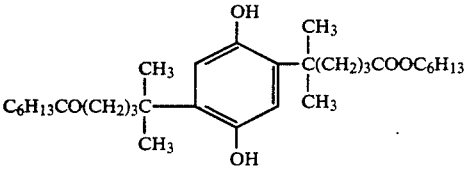
SU-1
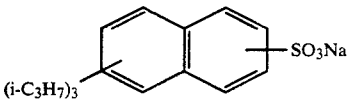

-continued

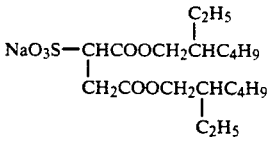

SU-2

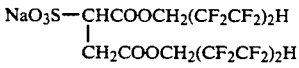

SU-3

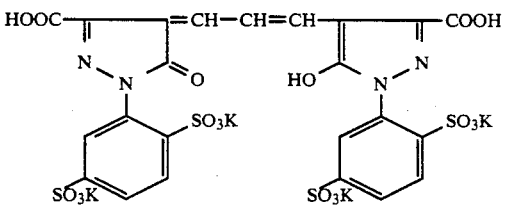

AI-1

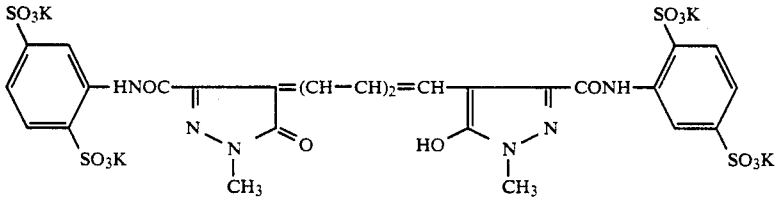

AI-2

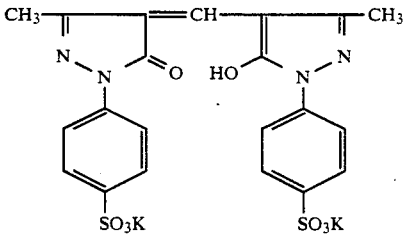

AI-3

TABLE 2

| Sample number | Blue-sensitive emulsion number | Sensitizing dye I | Sensitizing dye II | Sensitivity | Fogging | Reciprocity law failure (%) | Humidity dependency (%) |
|---|---|---|---|---|---|---|---|
| 42 (comparative) | Em-D1 | I-4 | — | 100 | 0.03 | 56 | 93 |
| 43 (comparative) | Em-D1 | I-9 | — | 102 | 0.04 | 60 | 94 |
| 44 (comparative) | Em-D1 | — | II-3 | 103 | 0.04 | 52 | 94 |
| 45 (comparative) | Em-D1 | — | II-8 | 108 | 0.03 | 57 | 93 |
| 46 (comparative) | Em-D1 | I-4 | II-3 | 107 | 0.04 | 60 | 92 |
| 47 (comparative) | Em-D1 | I-4 | II-8 | 109 | 0.04 | 58 | 94 |
| 48 (comparative) | Em-D2 | I-4 | — | 148 | 0.14 | 60 | 90 |
| 49 (comparative) | Em-D2 | I-9 | — | 147 | 0.17 | 63 | 92 |
| 50 (comparative) | Em-D2 | — | II-3 | 143 | 0.18 | 57 | 92 |
| 51 (comparative) | Em-D2 | — | II-8 | 150 | 0.16 | 62 | 90 |
| 52 (comparative) | Em-D2 | I-4 | II-3 | 138 | 0.15 | 65 | 92 |
| 53 (comparative) | Em-D2 | I-4 | II-8 | 142 | 0.13 | 63 | 93 |
| 54 (comparative) | Em-D3 | I-4 | — | 146 | 0.03 | 52 | 79 |
| 55 (comparative) | Em-D3 | I-9 | — | 143 | 0.03 | 54 | 80 |
| 56 (comparative) | Em-D3 | — | II-3 | 142 | 0.04 | 55 | 80 |
| 57 (comparative) | Em-D3 | — | II-8 | 149 | 0.04 | 54 | 82 |
| 58 (comparative) | Em-D3 | I-4 | II-3 | 141 | 0.04 | 62 | 84 |
| 59 (comparative) | Em-D3 | I-4 | II-8 | 140 | 0.04 | 63 | 83 |
| 60 (comparative) | Em-E1 | I-4 | — | 90 | 0.04 | 73 | 90 |
| 61 (comparative) | Em-E1 | I-9 | — | 92 | 0.05 | 70 | 89 |
| 62 (comparative) | Em-E1 | — | II-3 | 91 | 0.03 | 72 | 88 |
| 63 (comparative) | Em-E1 | — | II-8 | 95 | 0.04 | 74 | 92 |
| 64 (comparative) | Em-E1 | I-4 | II-3 | 93 | 0.03 | 69 | 89 |
| 65 (comparative) | Em-E1 | I-4 | II-8 | 93 | 0.04 | 73 | 91 |
| 66 (comparative) | Em-E2 | I-4 | — | 143 | 0.11 | 75 | 90 |
| 67 (comparative) | Em-E2 | I-9 | — | 139 | 0.19 | 70 | 88 |
| 68 (comparative) | Em-E2 | — | II-3 | 146 | 0.20 | 73 | 89 |
| 69 (comparative) | Em-E2 | — | II-8 | 149 | 0.18 | 76 | 91 |
| 70 (comparative) | Em-E2 | I-4 | II-3 | 147 | 0.17 | 72 | 88 |
| 71 (comparative) | Em-E2 | I-4 | II-8 | 145 | 0.16 | 74 | 90 |
| 72 (comparative) | Em-E3 | I-4 | — | 130 | 0.04 | 73 | 78 |

TABLE 2-continued

| Sample number | Blue-sensitive emulsion number | Sensitizing dye I | Sensitizing dye II | Sensitivity | Fogging | Reciprocity law failure (%) | Humidity dependency (%) |
|---|---|---|---|---|---|---|---|
| 73 (comparative) | Em-E3 | I-9 | — | 131 | 0.05 | 69 | 80 |
| 74 (comparative) | Em-E3 | — | II-3 | 128 | 0.04 | 70 | 82 |
| 75 (comparative) | Em-E3 | — | II-8 | 126 | 0.03 | 74 | 79 |
| 76 (comparative) | Em-E3 | I-4 | II-3 | 124 | 0.04 | 71 | 81 |
| 77 (comparative) | Em-E3 | I-4 | II-8 | 120 | 0.04 | 73 | 77 |
| 78 (comparative) | Em-F1 | I-4 | — | 99 | 0.05 | 83 | 91 |
| 79 (comparative) | Em-F1 | I-9 | — | 101 | 0.04 | 81 | 93 |
| 80 (comparative) | Em-F1 | — | II-3 | 100 | 0.04 | 85 | 94 |
| 81 (comparative) | Em-F1 | — | II-8 | 98 | 0.05 | 84 | 90 |
| 82 (comparative) | Em-F1 | I-4 | II-3 | 107 | 0.04 | 84 | 89 |
| 83 (comparative) | Em-F1 | I-4 | II-8 | 110 | 0.05 | 87 | 93 |
| 84 (comparative) | Em-F2 | I-4 | — | 141 | 0.18 | 88 | 86 |
| 85 (comparative) | Em-F2 | I-9 | — | 140 | 0.17 | 89 | 85 |
| 86 (comparative) | Em-F2 | — | II-3 | 137 | 0.19 | 84 | 87 |
| 87 (comparative) | Em-F2 | — | II-8 | 143 | 0.13 | 89 | 89 |
| 88 (comparative) | Em-F2 | I-4 | II-3 | 140 | 0.14 | 88 | 84 |
| 89 (comparative) | Em-F2 | I-4 | II-8 | 139 | 0.16 | 91 | 88 |
| 90 (comparative) | Em-F3 | I-4 | — | 130 | 0.05 | 90 | 70 |
| 91 (comparative) | Em-F3 | I-9 | — | 132 | 0.04 | 88 | 73 |
| 92 (comparative) | Em-F3 | — | II-3 | 130 | 0.06 | 87 | 72 |
| 93 (comparative) | Em-F3 | — | II-8 | 129 | 0.04 | 89 | 75 |
| 94 (Inventive) | Em-F3 | I-4 | II-3 | 133 | 0.03 | 93 | 93 |
| 95 (Inventive) | Em-F3 | I-4 | II-8 | 140 | 0.03 | 96 | 98 |
| 96 (Inventive) | Em-F3 | I-2 | II-3 | 138 | 0.04 | 89 | 90 |
| 97 (Inventive) | Em-F3 | I-2 | II-8 | 141 | 0.03 | 88 | 93 |
| 98 (Inventive) | Em-F3 | I-2 | II-9 | 137 | 0.04 | 91 | 88 |
| 99 (Inventive) | Em-F3 | I-3 | II-3 | 133 | 0.04 | 92 | 83 |
| 100 (Inventive) | Em-F3 | I-3 | II-8 | 139 | 0.04 | 90 | 91 |
| 101 (Inventive) | Em-F3 | I-3 | II-9 | 132 | 0.04 | 92 | 89 |
| 102 (Inventive) | Em-F3 | I-5 | II-3 | 140 | 0.04 | 87 | 89 |
| 103 (Inventive) | Em-F3 | I-5 | II-8 | 138 | 0.05 | 93 | 90 |
| 104 (Inventive) | Em-F3 | I-5 | II-9 | 135 | 0.04 | 90 | 87 |
| 105 (Inventive) | Em-F3 | I-6 | II-3 | 133 | 0.05 | 88 | 88 |
| 106 (Inventive) | Em-F3 | I-6 | II-8 | 141 | 0.04 | 94 | 92 |
| 107 (Inventive) | Em-F3 | I-6 | II-9 | 139 | 0.04 | 93 | 89 |
| 108 (Inventive) | Em-F3 | I-7 | II-3 | 133 | 0.04 | 91 | 88 |
| 109 (Inventive) | Em-F3 | I-7 | II-8 | 138 | 0.04 | 93 | 90 |

Table 2 demonstrates that sample Nos. 94 through 109, which were prepared by multilayer coating an emulsion of the configuration of the present invention, are highly sensitive, less liable to fogging and excellent in reciprocity law failure property and shows stable fluctuation of sensitivity upon humidity change as found in Example 1 despite that the combination of sensitizing dyes was changed.

Example 3

Emulsions were prepared in the same manner as with the emulsions EMP-D and EMP-F in Example 2 except that the amounts of elemental sulfur and sensitizing dyes added to EMP-F were varied as shown in Table 3. The obtained emulsions were each coated in the same layer configuration as in Example 2, and the resulting samples were subjected to exposure, developing and evaluation in the same manner as in Example 2. The results are shown in Table 3.

I-4 and II-8 were used as sensitizing dyes I and II, respectively.

As seen in Table 3, the samples prepared in accordance with the present invention were found to be highly sensitive, less liable to fogging and excellent in reciprocity law failure property and show stable fluctuation of sensitivity upon humidity change, but the effect depended on the amounts of potassium hexachloroiridate, potassium hexacyanoferrate (II) trihydrate and inorganic sulfur; when the amount of addition was out of the preferred range, the sensitivity declines, fogging becomes more liable to occur, or the improving effect on reciprocity law failure property becomes insufficient. This finding suggests the presence of a suitable amount range.

With respect to the combination of the amounts of sensitizing dyes added, it was found preferable to increase the ratio of the sensitizing dye II to the sensitizing dye I.

TABLE 3

| Sample number | $K_3IrCl_6$ | $K_4Fe(CN)_6$ | Elemental sulfur (mg/molAgX) | Sensitizing dye I (mol/molAgX) | Sensitizing dye II (mol/molAgX) | Sensitivity | Fogging | Reciprocity law failure (%) | Humidity dependency (%) |
|---|---|---|---|---|---|---|---|---|---|
| 110 (comparative) | — | — | — | $2.0 \times 10^{-4}$ | $2.0 \times 10^{-4}$ | 100 | 0.14 | 60 | 90 |
| 111 (Inventive) | $5 \times 10^{-5}$ | $1 \times 10^{-6}$ | 0.5 | $2.0 \times 10^{-4}$ | $2.0 \times 10^{-4}$ | 89 | 0.04 | 90 | 92 |
| 112 (Inventive) | $5 \times 10^{-6}$ | $1 \times 10^{-6}$ | 0.5 | $2.0 \times 10^{-4}$ | $2.0 \times 10^{-4}$ | 89 | 0.04 | 85 | 91 |
| 113 (Inventive) | $5 \times 10^{-7}$ | $1 \times 10^{-6}$ | 0.5 | $2.0 \times 10^{-4}$ | $2.0 \times 10^{-4}$ | 94 | 0.04 | 85 | 88 |
| 114 (Inventive) | $1 \times 10^{-8}$ | $1 \times 10^{-6}$ | 0.5 | $2.0 \times 10^{-4}$ | $2.0 \times 10^{-4}$ | 102 | 0.03 | 82 | 92 |
| 115 (Inventive) | $1 \times 10^{-9}$ | $1 \times 10^{-6}$ | 0.5 | $2.0 \times 10^{-4}$ | $2.0 \times 10^{-4}$ | 101 | 0.05 | 72 | 90 |
| 116 (Inventive) | $1 \times 10^{-10}$ | $1 \times 10^{-6}$ | 0.5 | $2.0 \times 10^{-4}$ | $2.0 \times 10^{-4}$ | 109 | 0.04 | 67 | 87 |
| 117 (Inventive) | $1 \times 10^{-11}$ | $1 \times 10^{-6}$ | 0.5 | $2.0 \times 10^{-4}$ | $2.0 \times 10^{-4}$ | 123 | 0.05 | 63 | 93 |
| 118 (Inventive) | $1 \times 10^{-8}$ | $1 \times 10^{-6}$ | 0.5 | $2.0 \times 10^{-4}$ | $2.0 \times 10^{-4}$ | 120 | 0.07 | 89 | 73 |

TABLE 3-continued

| Sample number | $K_3IrCl_6$ | $K_4Fe(CN)_6$ | Elemental sulfur (mg/molAgX) | Sensitizing dye I (mol/molAgX) | Sensitizing dye II (mol/molAgX) | Sensitivity | Fogging | Reciprocity law failure (%) | Humidity dependency (%) |
|---|---|---|---|---|---|---|---|---|---|
| 119 (Inventive) | $1 \times 10^{-8}$ | $1 \times 10^{-2}$ | 0.5 | $2.0 \times 10^{-4}$ | $2.0 \times 10^{-4}$ | 109 | 0.05 | 85 | 79 |
| 120 (Inventive) | $1 \times 10^{-8}$ | $1 \times 10^{-4}$ | 0.5 | $2.0 \times 10^{-4}$ | $2.0 \times 10^{-4}$ | 107 | 0.05 | 88 | 81 |
| 121 (Inventive) | $1 \times 10^{-8}$ | $1 \times 10^{-6}$ | 0.5 | $2.0 \times 10^{-4}$ | $2.0 \times 10^{-4}$ | 103 | 0.04 | 90 | 84 |
| 122 (Inventive) | $1 \times 10^{-8}$ | $1 \times 10^{-7}$ | 0.5 | $2.0 \times 10^{-4}$ | $2.0 \times 10^{-4}$ | 97 | 0.04 | 87 | 83 |
| 123 (Inventive) | $1 \times 10^{-8}$ | $1 \times 10^{-10}$ | 0.5 | $2.0 \times 10^{-4}$ | $2.0 \times 10^{-4}$ | 95 | 0.04 | 92 | 86 |
| 124 (Inventive) | $1 \times 10^{-8}$ | $1 \times 10^{-12}$ | 0.5 | $2.0 \times 10^{-4}$ | $2.0 \times 10^{-4}$ | 89 | 0.04 | 89 | 88 |
| 125 (Inventive) | $1 \times 10^{-8}$ | $1 \times 10^{-6}$ | 10 | $2.0 \times 10^{-4}$ | $2.0 \times 10^{-4}$ | 87 | 0.02 | 88 | 72 |
| 126 (Inventive) | $1 \times 10^{-8}$ | $1 \times 10^{-6}$ | 5 | $2.0 \times 10^{-4}$ | $2.0 \times 10^{-4}$ | 94 | 0.03 | 91 | 79 |
| 127 (Inventive) | $1 \times 10^{-8}$ | $1 \times 10^{-6}$ | 1 | $2.0 \times 10^{-4}$ | $2.0 \times 10^{-4}$ | 95 | 0.03 | 90 | 90 |
| 128 (Inventive) | $1 \times 10^{-8}$ | $1 \times 10^{-6}$ | 0.5 | $2.0 \times 10^{-4}$ | $2.0 \times 10^{-4}$ | 99 | 0.03 | 87 | 94 |
| 129 (Inventive) | $1 \times 10^{-8}$ | $1 \times 10^{-6}$ | $1 \times 10^{-3}$ | $2.0 \times 10^{-4}$ | $2.0 \times 10^{-4}$ | 110 | 0.04 | 85 | 90 |
| 130 (Inventive) | $1 \times 10^{-8}$ | $1 \times 10^{-6}$ | $1 \times 10^{-4}$ | $2.0 \times 10^{-4}$ | $2.0 \times 10^{-4}$ | 115 | 0.05 | 89 | 89 |
| 131 (Inventive) | $1 \times 10^{-8}$ | $1 \times 10^{-6}$ | $1 \times 10^{-5}$ | $2.0 \times 10^{-4}$ | $2.0 \times 10^{-4}$ | 129 | 0.08 | 92 | 88 |
| 132 (Inventive) | $1 \times 10^{-8}$ | $1 \times 10^{-6}$ | 0.5 | $2.5 \times 10^{-4}$ | $0.5 \times 10^{-4}$ | 93 | 0.04 | 88 | 87 |
| 133 (Inventive) | $1 \times 10^{-8}$ | $1 \times 10^{-6}$ | 0.5 | $3.0 \times 10^{-4}$ | $1.0 \times 10^{-4}$ | 105 | 0.05 | 91 | 91 |
| 134 (Inventive) | $1 \times 10^{-8}$ | $1 \times 10^{-6}$ | 0.5 | $2.8 \times 10^{-4}$ | $1.2 \times 10^{-4}$ | 114 | 0.04 | 90 | 90 |
| 135 (Inventive) | $1 \times 10^{-8}$ | $1 \times 10^{-6}$ | 0.5 | $2.0 \times 10^{-4}$ | $2.0 \times 10^{-4}$ | 107 | 0.03 | 92 | 92 |
| 136 (Inventive) | $1 \times 10^{-8}$ | $1 \times 10^{-6}$ | 0.5 | $1.2 \times 10^{-4}$ | $2.8 \times 10^{-4}$ | 115 | 0.03 | 97 | 98 |
| 137 (Inventive) | $1 \times 10^{-8}$ | $1 \times 10^{-6}$ | 0.5 | $1.0 \times 10^{-4}$ | $3.0 \times 10^{-4}$ | 120 | 0.04 | 95 | 97 |
| 138 (Inventive) | $1 \times 10^{-8}$ | $1 \times 10^{-6}$ | 0.5 | $0.5 \times 10^{-4}$ | $3.5 \times 10^{-4}$ | 108 | 0.04 | 89 | 98 |

Example 4

Thirteen kinds of emulsions were prepared in the same manner as in emulsion EMP-F in Example 2, provided that various amounts of ruthenium chloride or osmium chloride were used in place of potassium hexacyanoferrate (II). Each of the emulsion was chemically ripended for 90 minutes at 55° C. in the presence of 0.8 mg/mol AgX of sodium thiosulfate, 0.8 mg/mol AgX of chloroauric acid, elemental sulfur, sensitizing dyes and $6 \times 10^{-4}$ mol/mol AgX of stabilizer SB-5 to obtain a blue-sensitive emulsion. Samples 139 through 151 were prepared in the same manner as in the samples of Example 2 except that the above obtained blue-sensitive emulsions were used in blue-sensitive layer thereof. The samples were evaluated in the same manner as in Example 1. Contents and test results of each samples are shown in Table 4. As shown in the results, the effects of the invention could also be obtained when ruthenium chloride or osmium chloride were used in place of ion compound.

TABLE 4

| Sample number | $K_3IrCl_6$ | Ruthenium chloride | Osmium chloride | Elemental sulfur (mg/molAgX) | Sensitizing dye I-4 (mol/molAgX) | Sensitizing dye II-8 (mol/molAgX) | Sensitivity | Fogging | Reciprocity law failure (%) | Humidity dependency (%) |
|---|---|---|---|---|---|---|---|---|---|---|
| 139 (comparative) | $5 \times 10^{-6}$ | — | — | — | — | $2 \times 10^{-6}$ | 82 | 0.15 | 62 | 88 |
| 140 (comparative) | $5 \times 10^{-6}$ | — | — | — | $2 \times 10^{-5}$ | $2 \times 10^{-6}$ | 100 | 0.17 | 60 | 90 |
| 141 (comparative) | $5 \times 10^{-6}$ | — | — | 0.3 | $2 \times 10^{-5}$ | $2 \times 10^{-6}$ | 90 | 0.05 | 58 | 85 |
| 142 (Inventive) | $5 \times 10^{-6}$ | $1 \times 10^{-2}$ | — | 0.3 | $2 \times 10^{-5}$ | $2 \times 10^{-6}$ | 83 | 0.05 | 75 | 87 |
| 143 (Inventive) | $5 \times 10^{-6}$ | $1 \times 10^{-4}$ | — | 0.3 | $2 \times 10^{-5}$ | $2 \times 10^{-6}$ | 91 | 0.06 | 81 | 88 |
| 144 (Inventive) | $5 \times 10^{-6}$ | $1 \times 10^{-6}$ | — | 0.3 | $2 \times 10^{-5}$ | $2 \times 10^{-6}$ | 94 | 0.05 | 89 | 88 |
| 145 (Inventive) | $5 \times 10^{-6}$ | $1 \times 10^{-8}$ | — | 0.3 | $2 \times 10^{-5}$ | $2 \times 10^{-6}$ | 92 | 0.05 | 88 | 89 |
| 146 (Inventive) | $5 \times 10^{-6}$ | $1 \times 10^{-10}$ | — | 0.3 | $2 \times 10^{-5}$ | $2 \times 10^{-6}$ | 91 | 0.05 | 83 | 88 |
| 147 (Inventive) | $5 \times 10^{-6}$ | — | $1 \times 10^{-2}$ | 0.3 | $2 \times 10^{-5}$ | $2 \times 10^{-6}$ | 88 | 0.05 | 84 | 87 |
| 148 (Inventive) | $5 \times 10^{-6}$ | — | $1 \times 10^{-4}$ | 0.3 | $2 \times 10^{-5}$ | $2 \times 10^{-6}$ | 99 | 0.05 | 90 | 88 |
| 149 (Inventive) | $5 \times 10^{-6}$ | — | $1 \times 10^{-6}$ | 0.3 | $2 \times 10^{-5}$ | $2 \times 10^{-6}$ | 104 | 0.04 | 91 | 90 |
| 150 (Inventive) | $5 \times 10^{-6}$ | — | $1 \times 10^{-8}$ | 0.3 | $2 \times 10^{-5}$ | $2 \times 10^{-6}$ | 105 | 0.04 | 91 | 89 |
| 151 (Inventive) | $5 \times 10^{-6}$ | — | $1 \times 10^{-10}$ | 0.3 | $2 \times 10^{-5}$ | $2 \times 10^{-6}$ | 100 | 0.05 | 90 | 88 |

What is claimed is:

1. A silver halide color photographic light-sensitive material comprising a support having thereon a silver halide emulsion layer which contains silver halide grins each containing an iridium compound and a compound containing iron, cobalt, nickel, ruthenium, rhodium, palladium, osmium or platinum;

elemental sulfur; and a sensitizing dye represented by formula I and a sensitizing dye represented by formula II;

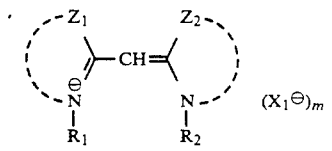

(I)

wherein $Z_1$ and $Z_2$ are each a group of atoms necessary for forming a thiazole ring, a selenazole ring, a benzothiazole ring, a benzoselenazole ring, a naphthothiazole ring or a naphthoselenazole ring provided that at least one of $Z_1$ and $Z_2$ is a naphthothiazole ring or a naphthoselenazole ring; $R_1$ and $R_2$ are each an aliphatic group provided that at least one of them is an aliphatic group having a carboxyl group or a sulfo group; $X_1^{\beta}$ is an acid anion and m is 0 or 1;

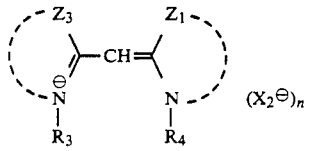

(II)

wherein $Z_3$ and $Z_4$ are each a group of atoms necessary for forming a thiazole ring, a benzothiazole ring or a benzoselenazole ring; $R_3$ and $R_4$ are each an aliphatic group provided that at least one of them is an aliphatic group having a carboxyl group or a sulfo group; $X_2^{\ominus}$ is an acid anion and m is 0 or 1.

2. A light-sensitive material of claim 1, wherein said silver halide grains contain said pyridium compound in an amount of from $1\times10^{-11}$ mol to $1\times10^{-5}$ mol per mol of silver and said compound containing iron, cobalt, nickel, ruthenium, rhodium, palladium, osmium or platinum in an amount of from $1\times10^{-9}$ mol to $1\times10^{-3}$ mol per mol of silver.

3. A light-sensitive material of claim 2, wherein said silver halide grains contain said iridium compound in an amount of from $1\times10^{-9}$ mol to $1\times10^{-6}$ mol per mol of silver and said compound containing iron, cobalt, nickel, ruthenium, rhodium, palladium, osmium or platinum in an amount of from $1\times10^{-8}$ mol to $1\times10^{-4}$ mol per mol of silver.

4. A light-sensitive material of claim 1, wherein said elemental sulfur is contained in said emulsion layer in an amount of $1\times10^{-5}$ mg to 10 mg per mol of silver contained in said silver halide emulsion layer.

5. A light-sensitive material of claim 4, wherein said elemental sulfur is contained in said emulsion layer in an amount of $1\times10^{-3}$ mg to 5 mg per mol of silver contained in said silver halide emulsion layer.

6. A light-sensitive material of claim 1, wherein said sensitizing dye represented by formula I and said sensitizing dye represented by formula II are contained in said silver halide emulsion layer in a ratio of from 1:1.5 to 1:8.

7. A light-sensitive material of claim 6, wherein said sensitizing dye represented by formula I and said sensitizing dye represented by formula II are contained in said silver halide emulsion layer in a ratio of from 1:2 to 1:4.

8. A light-sensitive material of claim 1, wherein said silver halide grains comprise silver chloride or silver chlorobromide having a silver chloride content of not less than 90 mol. %.

9. A light-sensitive material of claim 8, wherein said silver halide grains comprise silver chlorobromide having a silver chloride content of from 98 mol. % to 99.5 mol. %.

10. A light-sensitive material of claim 1, wherein said silver halide emulsion layer contains a compound represented by formula S;

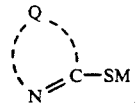

(S)

wherein Q is a group of atoms necessary for forming a heterocyclic ring and M is a hydrogen atom or a cation.

11. The light-sensitive material of claim 1, wherein said silver halide grins contain said iridium compound in an amount of from $1\times10^{-11}$ mol to $1\times10^{-5}$ mol per mol of silver and said compound containing iron, cobalt, nickel, ruthenium, rhodium, palladium, osmium or platinum in an amount of from $1\times10^{-9}$ mol to $1\times10^{-3}$ mol per mol of silver;

said elemental sulfur is contained in an amount of $1\times10^{-5}$ mg to 10 mg per mol of silver in said silver halide emulsion layer;

said sensitizing dyes are contained in a total amount of $2\times10^{-6}$ to $1\times10^{-3}$ mol per mole of silver halide in said silver halide emulsion layer; and said sensitizing dye represented by formula I and said sensitizing dye represented by formula II are contained in said silver halide emulsion layer in a ratio of from 1:1.5 to 1:8.

12. A silver halide color photographic light-sensitive material comprising a support having thereon a silver halide emulsion layer which contains silver chlorobromide grins having a silver chloride content of from 98 mol. % to 99.5 mol. % and containing an iridium compound and a compound containing iron, cobalt, nickel, ruthenium, rhodium, palladium, osmium or platinum; elemental sulfur in an amount of $1\times10^{-5}$ mg to 10 mg per mole of silver contained in said silver halide emulsion layer;

a sensitizing dye represented by formula I and a sensitizing dye represented by formula II in a ratio of from 1:2 to 1:4;

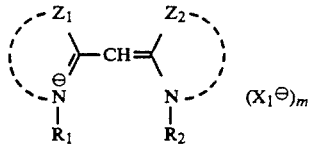

(I)

wherein $Z_1$ and $Z_2$ are each a group of atoms necessary for forming a thiazole ring, a selenazole ring, a benzothiazole ring, a benzoselenazole ring, a naphthothiazole ring or a naphthoselenazole ring provided that at least one of $Z_1$ and $Z_2$ is a naphthothiazole ring or a naphthoselenazole ring; $R_1$ and $R_2$ are each an aliphatic group provided that at least one of them is an aliphatic group having a carboxyl group or a sulfo group; $X_1^{\ominus}$ is an acid anion and m is 0 or 1;

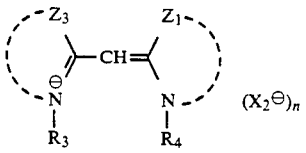

(II)

wherein $Z_3$ and $Z_4$ are each a group of atoms necessary for forming a thiazole ring, a benzothiazole ring or a benzoselenazole ring; $R_3$ and $R_4$ are each an aliphatic group provided that at least one of them is an aliphatic group having a carboxyl group or a sulfo group; $X_2\ominus$ is an acid anion and m is 0 or 1; and a sulfur sensitizer compound represented by formula S;

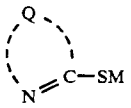

(S)

wherein Q is a group of atoms necessary for forming a heterocyclic ring and M is a hydrogen atom or a cation.

13. The light sensitive material of claim 12 wherein said sensitizing dyes are contained in a total amount of $2\times10^{-6}$ to $1\times10^{-3}$ power mole of silver halide in said silver halide emulsion layer.

14. The light sensitive material of claim 1, 2, 4, 6, 8, 10, 12, 11 or 13, wherein said sensitizing dye of formula I is selected from sensitizing dyes consisting of compounds represented by formulas I-1 through I-10, presented below, and said sensitizing dye of formula II is selected from sensitizing dyes consisting of compounds represented by formula II-1 through II-11, presented below:

I-1

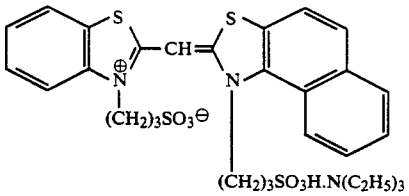

I-2

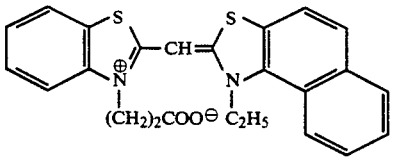

I-3

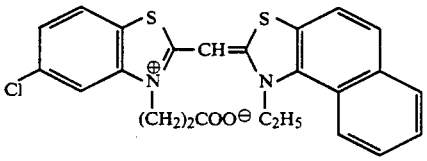

-continued

I-4

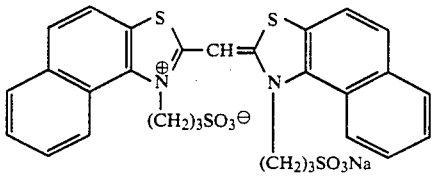

I-5

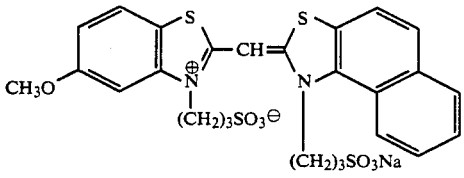

I-6

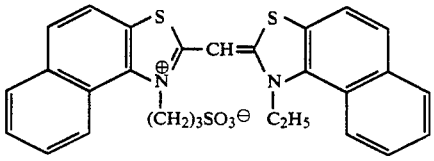

I-7

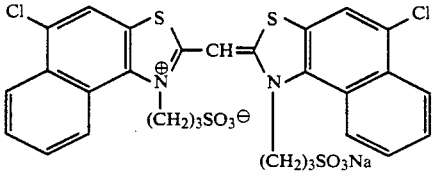

I-8

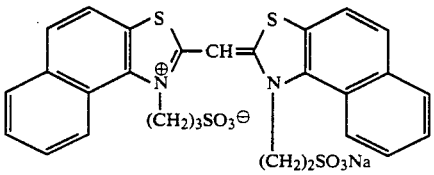

I-9

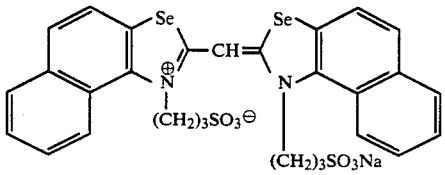

I-10

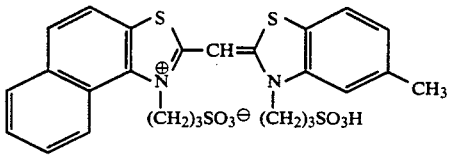

II-1

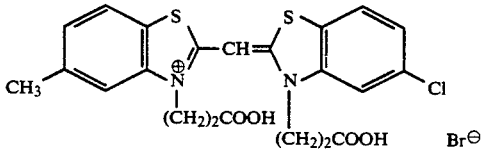

II-2

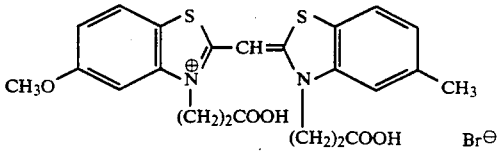

-continued
II-3
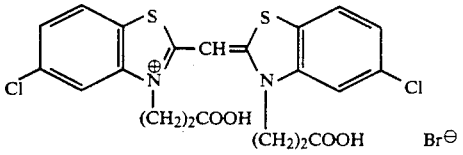
II-4
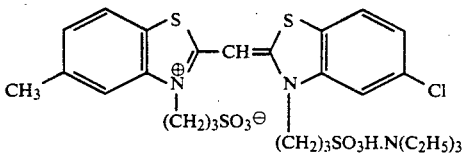
II-5
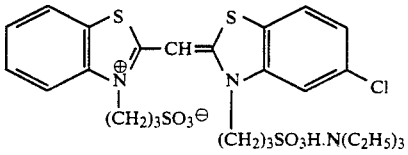
II-6
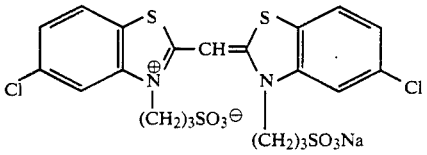
-continued
II-7
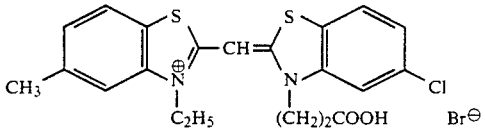
II-8
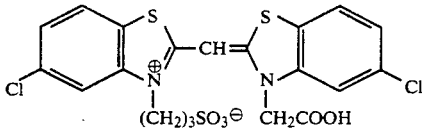
II-9
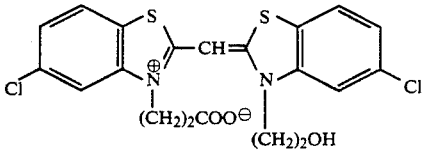
II-10
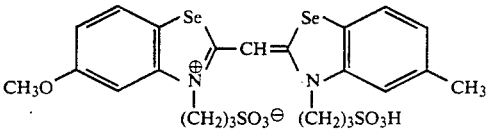
II-11
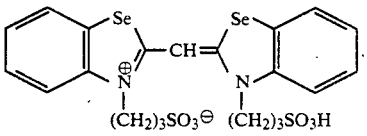
* * * * *